US006983714B2

(12) United States Patent
Dove et al.

(10) Patent No.: US 6,983,714 B2
(45) Date of Patent: Jan. 10, 2006

(54) METHOD OF AND APPARATUS FOR OFFSHORE MOORING

(75) Inventors: Peter G. S. Dove, Magnolia, TX (US); Johannes Jacobus Treu, Seabrook, TX (US)

(73) Assignee: Technip France, Courbevoie (FR)

( * ) Notice: Subject to any disclaimer, the term of this patent is extended or adjusted under 35 U.S.C. 154(b) by 740 days.

(21) Appl. No.: 09/883,459

(22) Filed: Jun. 15, 2001

(65) Prior Publication Data

US 2002/0189522 A1 Dec. 19, 2002

(51) Int. Cl.
*B63B 21/50* (2006.01)

(52) U.S. Cl. ..... 114/293; 114/230.2

(58) Field of Classification Search ..... 114/293, 114/230.1, 230.2, 230.22, 230.23, 230.24, 114/230.25, 230.26; 405/224
See application file for complete search history.

(56) References Cited

U.S. PATENT DOCUMENTS 3,889,621 A * 6/1975 Pease ..... 114/294
4,067,282 A * 1/1978 Guinn et al. ..... 114/230.2
5,097,787 A * 3/1992 Bruce ..... 114/293
6,457,908 B1 * 10/2002 Bergeron ..... 405/224

OTHER PUBLICATIONS

Bruce Tensioner Databook, Bruce Anchor Limited, Isle of Man, British Isles.
Vryhof Anchor Manual 2000, Vryhof anchors b.v., krimpen a/d yssel, The Netherlands, 1999, pp. 88-93, pp. 106-107.
The Bruce Tensioner Patented, A Compact One-Piece Chain Clutching Device for Pretensioning Chains Attached to Opposed Anchors of Piles.

* cited by examiner

*Primary Examiner*—Andrew D. Wright
(74) *Attorney, Agent, or Firm*—Klein, O'Neill & Singh, LLP; Howard J. Klein

(57) ABSTRACT

In a method of and apparatus for offshore mooring, a clamping apparatus includes a clamping mechanism and a pulley. A mooring line connected to an anchor or a pendant line connected to a vessel to be moored extends through the clamping mechanism and around the pulley of the clamping apparatus. The distal end of the line extending through the clamping apparatus is connected to an anchor handling vessel. The anchor handling vessel is employed to apply a predetermined tension to the pendant line and the preset mooring line. A remote operated vehicle is then employed to actuate the clamping apparatus and to disengage the anchor handling vessel.

92 Claims, 32 Drawing Sheets

46
50
49
47
48
43
66
20
40
44
41
42
30
4
4

46
48
66
58
49
47
40
42
20

43
20

METHOD OF AND APPARATUS FOR OFFSHORE MOORING

BACKGROUND AND SUMMARY OF THE INVENTION

Mobile offshore drilling units (MODUs), floating production platforms (FPPs), SPARS, and similar vessels are often moored at offshore venues utilizing either preset catenary mooring lines or preset taut-leg mooring lines. Mooring is accomplished by first attaching a plurality of preset mooring lines to the vessel to be moored, and thereafter applying a predetermined tension to each of the mooring lines. Heretofore the necessary tension has been applied to the mooring lines utilizing winches mounted on the vessel to be moored.

Winches having sufficient capacity to be used in tensioning mooring lines of the type used in offshore mooring operations are exceedingly expensive, but are used only intermittently, such as during the initial mooring of the vessel upon which they are installed, during relocation of the vessel, and in response to changing conditions at the mooring site. Thus, a need exists for method of and apparatus for mooring MODUs, FPPs, SPARs, and similar vessels at offshore venues which does not require the installation of mooring winches on the vessel to be moored.

Offshore mooring can also be accomplished using a technique known as dynamic positioning. The dynamic positioning technique involves the use of one or more propulsion devices mounted on the vessel to be moored which are operated to maintain the vessel at a specified location as determined by GPS technology. Although generally satisfactory in operation, dynamic positioning systems require the consumption of substantial amounts of fuel and are therefore expensive to operate. The fuel consumption necessary in the operation of dynamic positioning systems also raises environmental concerns.

The present invention comprises a method of and apparatus for offshore mooring which fulfills the foregoing and other requirements long since found lacking in the prior art. In accordance with a first embodiment of the apparatus of the invention, a clamping apparatus is provided at the distal end of either a preset catenary mooring line or a preset taut-leg mooring line. A wire or chain pendant extends from the vessel to be moored through the clamping apparatus. The distal end of the pendant is connected to a line which extends to a winch mounted on an anchor handling vessel. The winch is utilized to pull the pendant through the clamping apparatus until a predetermined tension is exerted on the mooring line and the pendant. The clamping apparatus is then actuated to securely clamp the pendant to the mooring line while maintaining the predetermined tension. In this matter the tension necessary to properly moor the vessel at the offshore site is achieved without requiring the use of mooring winches on the vessel being moored.

In accordance with more specific aspects of the invention, a remotely operated vehicle (ROV) is deployed from the anchor handling vessel. A chain is mounted at the distal end of the pendant, and a submersible buoy is mounted at the distal end of the chain. The line deployed from the winch on the anchor handling vessel is secured to the pendant during tensioning operations.

The chain portion of the pendant extends around a pulley or sheave mounted on the clamping apparatus. When the predetermined tension has been applied to the mooring line and the pendant by the winch on the anchor handling vessel, the ROV actuates the clamping apparatus to securely clamp the pendant to the mooring line while maintaining the predetermined tension. Thereafter, the ROV disengages the vessel from the pendant.

In accordance with a first embodiment of the method of the invention, a clamping apparatus is mounted at the distal end of a preset mooring line. The clamping apparatus is brought on board an anchor handling vessel. A pendant extending from a vessel to be moored is directed through the clamping apparatus and is secured to a line extending from a winch mounted on the anchor handling vessel. The clamping apparatus having the pendant extending therethrough is then lowered into the sea, and the winch on the anchor handling vessel is operated to apply increasing tension to the pendant and the mooring line until a predetermined tension is achieved. An ROV deployed from the anchor handling vessel is then utilized to actuate the clamping apparatus to securely clamp the pendant into engagement with the mooring line while maintaining the predetermined tension, and thereafter to disengage the pendant from the anchor handling vessel.

BRIEF DESCRIPTION OF THE DRAWINGS

A more completely understanding of the invention may be had by reference to the following Detailed Description when taken in conjunction with the accompanying Drawings, wherein.

DETAILED DESCRIPTION

Figure 1:
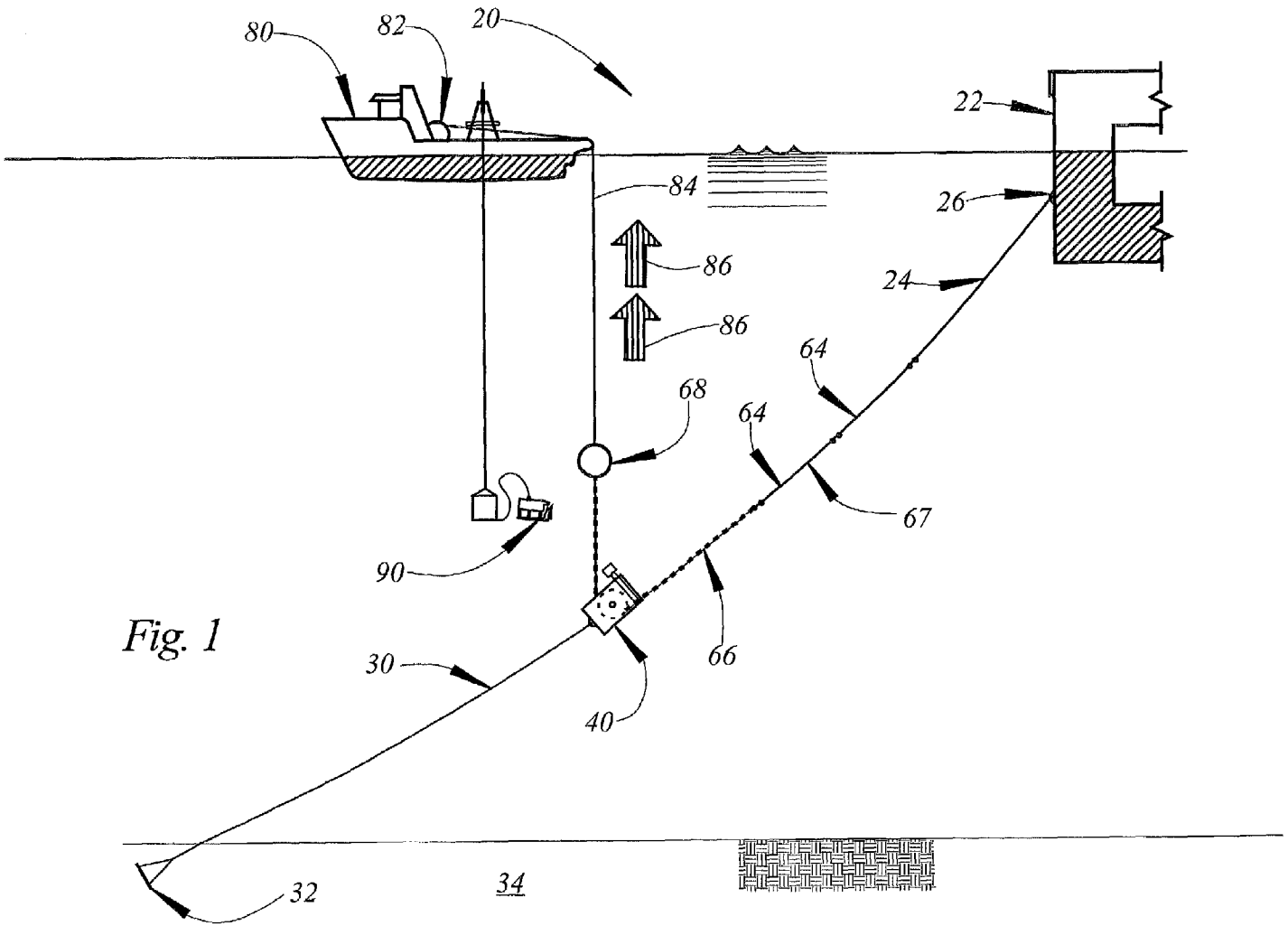
FIG. 1 is a diagrammatic illustration of an apparatus for offshore mooring comprising a first embodiment of the invention.

Referring now the Drawings, and particularly to FIGS. 1 through 6 thereof, there is shown method of and apparatus for offshore mooring 20 comprising a first embodiment of the invention. In accordance with the invention, a vessel to be moored (VTBM) 22 is located at an offshore venue. The VTBM may comprise a mobile offshore drilling unit, a floating production platform (monohull or semisubmersible), a SPAR, or any other vessel requiring offshore mooring. A plurality of wire or chain mooring attachment pendants 24 are secured to the VTBM at spaced apart locations around the circumference thereof. Each mooring attachment pendant 24 is secured to the VTBM through a padeye 26. Each padeye 26 is provided with a tension measuring device such as a strain gauge. The function of the tension measuring device is to produce an output indicative of the tension applied to its associated padeye 26 by the mooring attachment pendant 24 secured thereto.

The apparatus for offshore mooring 20 further includes a plurality of mooring lines 30. As will be appreciated by those skilled in the art, each mooring line 30 comprises multiple components, including wire, chain, connectors, etc. The major part of each mooring line 30 is installed before the VTBM is on site; therefore, the mooring lines 30 are referred to as preset mooring lines. Each preset mooring line 30 extends from an anchor 32 which is securely engaged with the sea floor 34. The preset mooring lines 30 may be secured to the sea floor by drag embedment anchors, vertically loaded anchors, driven piles, suction anchors, suction embedded plate anchors, or other anchor types suitable for offshore mooring.

As will be appreciated by those skilled in the art, the preset mooring lines 30 may comprise either catenary preset mooring lines or taut-leg preset mooring lines. The mooring lines 30 are equal in number to the number of mooring attachment pendants 24 secured to the VTBM, and are positioned around the site at which the VTBM is to be moored in a more or less circular array.

Figures 3, 4, 5:
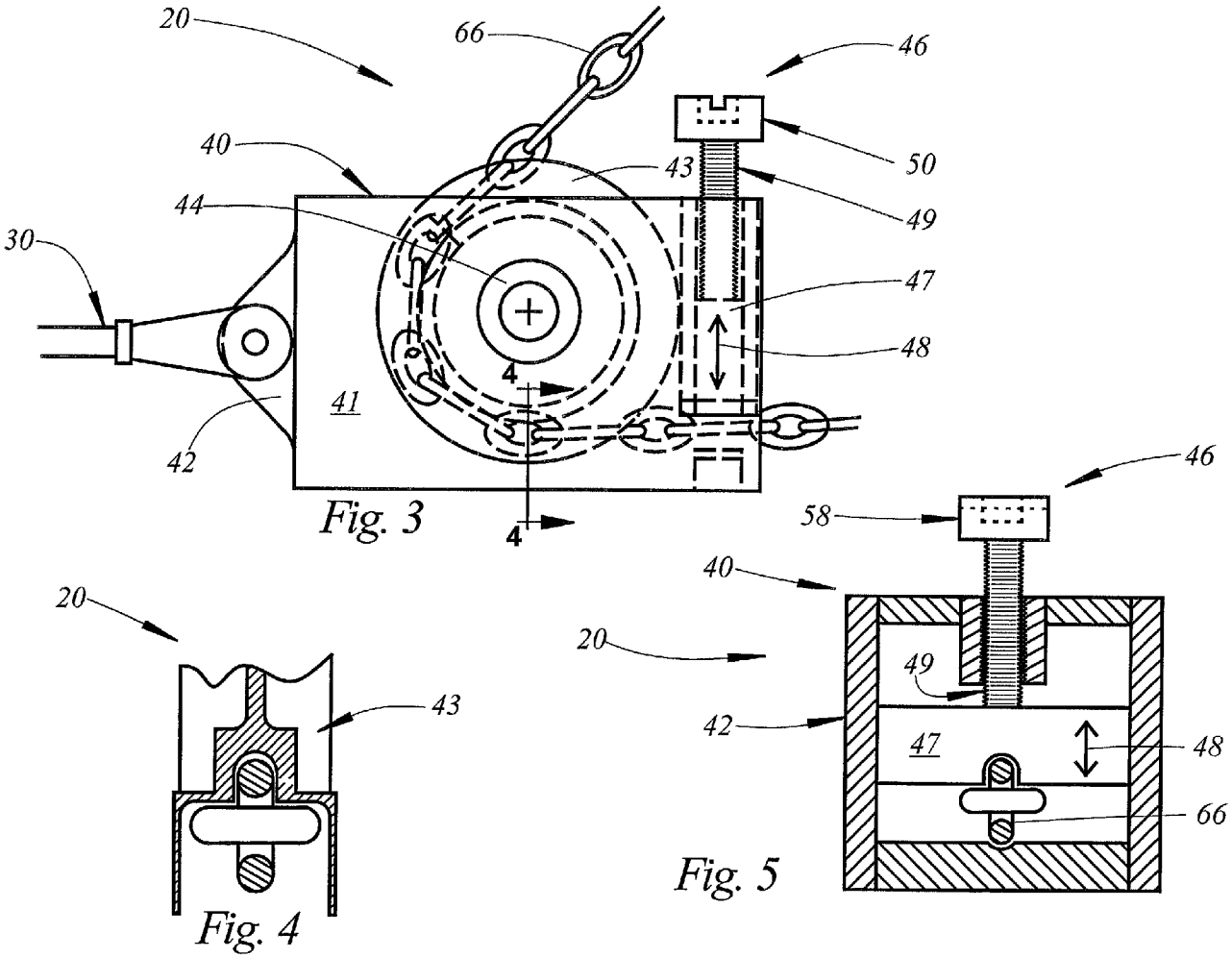
FIG. 3 is an enlargement of a portion of FIG. 1.
FIG. 4 is a sectional view taken along the line 44 in FIG. 3 in the direction of the arrows.
FIG. 5 is a transverse sectional view taken through the apparatus of FIG. 3 and further illustrating the clamping mechanism thereof.

In accordance with the first embodiment of the invention, each preset mooring line 30 has a clamping apparatus 40 secured to the distal end thereof. Referring particularly to FIGS. 3 and 4, each clamping apparatus 40 comprises a box shaped frame 41 having a padeye 42 mounted at one end thereof. The padeye 42 is utilized to secure the clamping apparatus 40 to its associated preset mooring line 30.

The clamping apparatus 40 includes a slotted sheave or pulley 43 which is rotatably supported on the frame 40 by suitable bearings 44. The sheave 43 includes a wide outer slot and a narrow inner slot. The clamping apparatus 40 further includes a clamping mechanism 46 mounted at the opposite end of the frame 42 from the padeye 42.

As is best shown in FIG. 3, the clamping mechanism 46 may comprise a chain stopper 47 which is slidedly supported in the frame 41 of the clamping apparatus 40 for movement in the direction of the arrows 48. A threaded member 49 is threadedly engaged with the frame 42. Therefore, upon rotation of the threaded member 49, the chain stopper 47 is selectively positioned relative to the frame 41. The threaded member 49 extends to a socket 50 which adapted for actuation by a remote operated vehicle (ROV).

Figure 6:
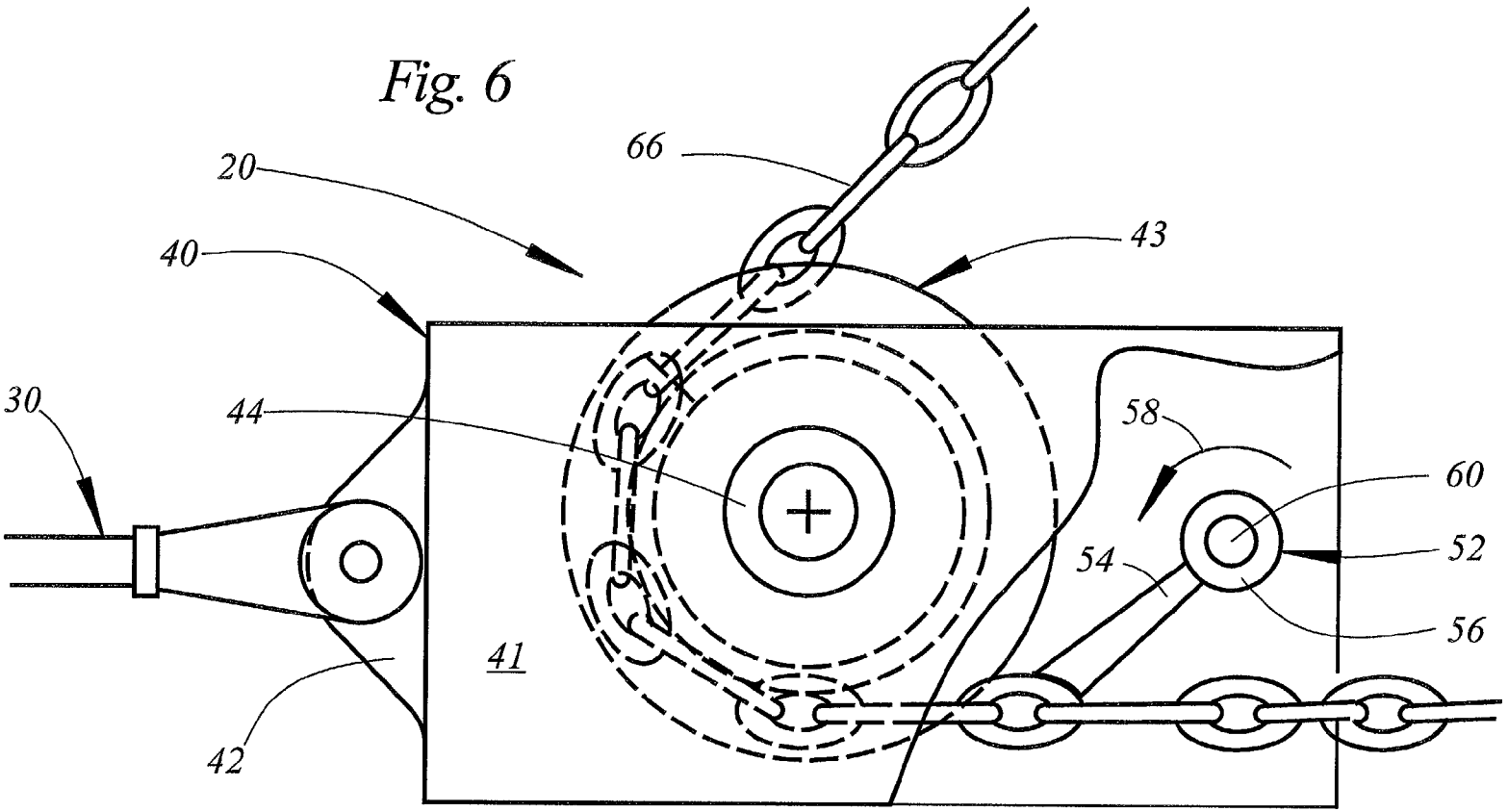
FIG. 6 is an illustration similar to FIG. 3 illustrating a clamping mechanism comprising a stopper arm.

Referring to FIG. 6, there is shown an alternative clamping mechanism 52 which may be incorporated in the clamping apparatus 40 in lieu of the clamping mechanism 46 shown in FIGS. 3 and 5. The clamping mechanism 52 comprises a stopper arm 54 which is pivotally supported on the frame 41 of the clamping apparatus 40 by a cylindrical member 56. The stopper arm 54 is spring biased to pivot in the direction indicated by the arrow 58. An arm 60 is secured to the stopper arm 54 and extends out of the frame 41 of the clamping apparatus 40 for actuation by a remote operated vehicle to selectively pivot the stopper arm 54 in the direction opposite of the arrow 58.

As is shown in FIG. 6, the stopper arm normally prevents a chain extending through the clamping apparatus 40 and around the slotted sheave 43 thereof for moving rightwardly (FIG. 6). However, the chain is free to move in the leftward direction (FIG. 6) because the stopper arm 54 simply pivots upwardly against the action of its spring bias until sufficient leftward movement has occurred for the stopper arm 54 to engage the next link of the chain. Whenever the remote operated vehicle is utilized to actuate the arm 60 to pivot the stopper arm 54 in the direction opposite that of the arrow 58, the chain is allowed to move freely in the rightward direction (FIG. 6).

Figure 6A:
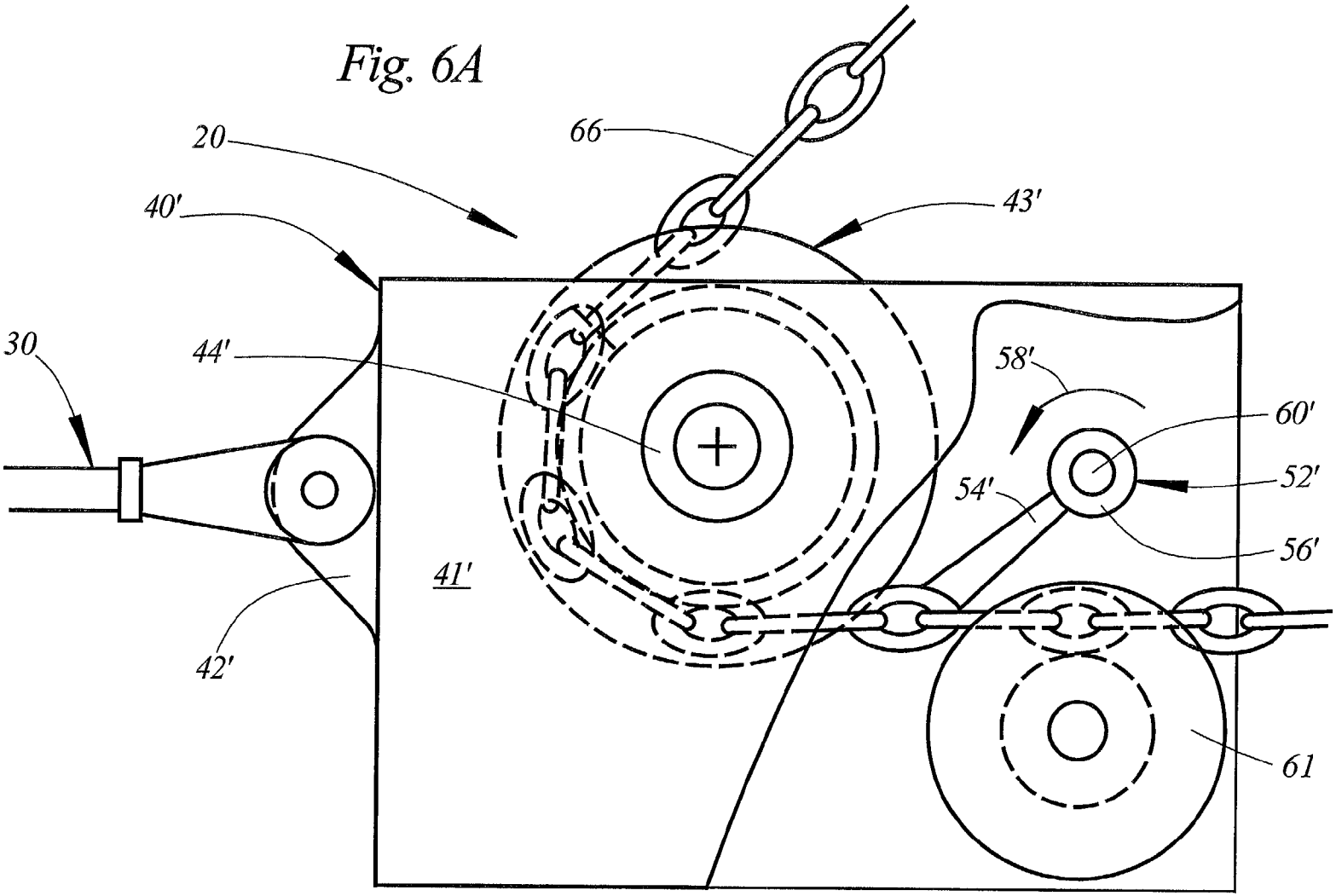
FIG. 6A is a view similar to FIG. 6 illustrating a variation of the mechanism shown therein.
Figure 7:
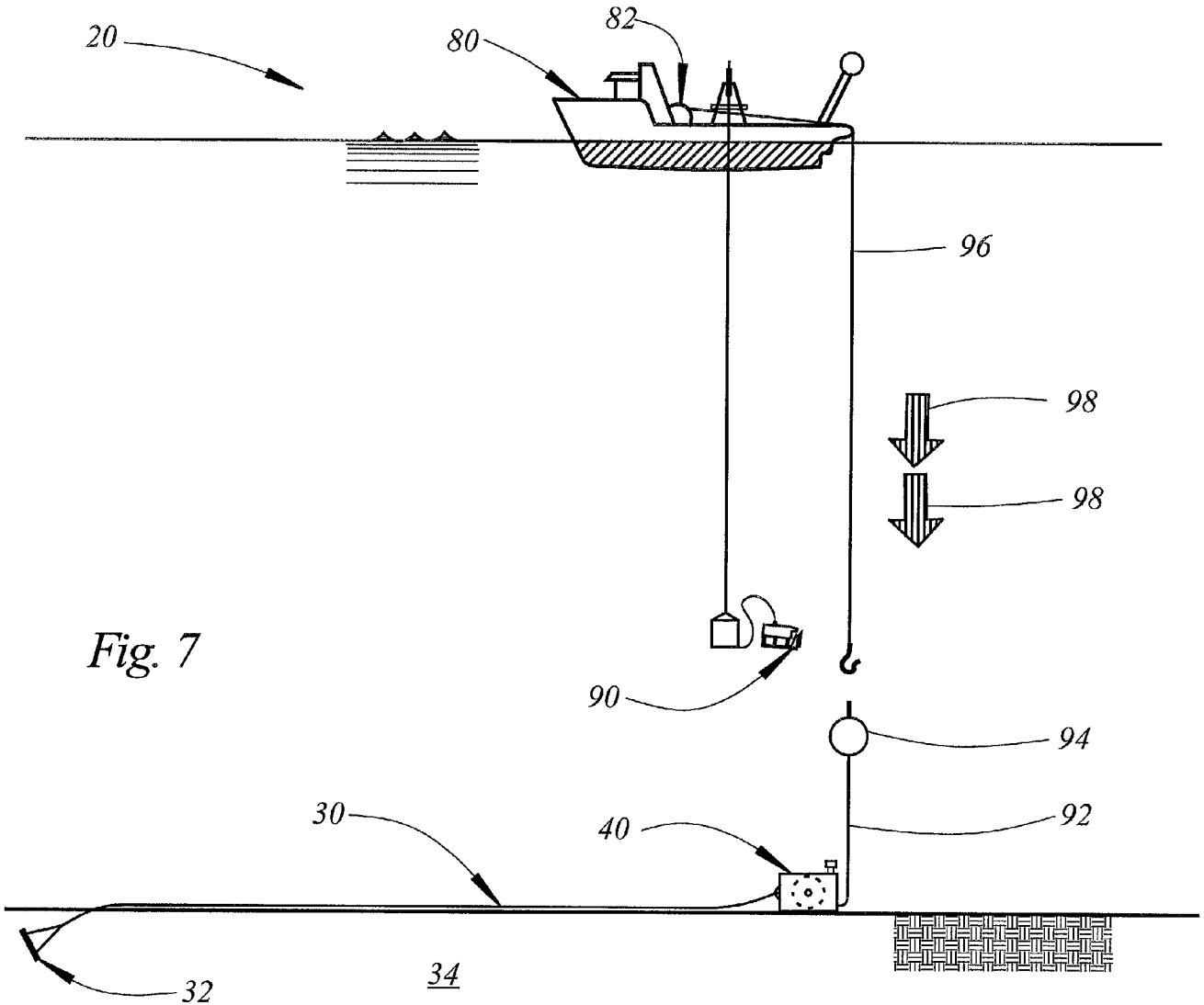
FIG. 7 is a diagrammatic illustration of a early steps in the method comprising the first embodiment of the invention.

Referring to FIG. 6A, there is shown a clamping apparatus 40' which may be used in lieu of the clamping apparatus 40 of FIG. 6. Many of the component parts of the clamping apparatus 40' are substantially identical to component parts comprising the clamping apparatus 40 as illustrated in FIG. 6 and described hereandabove in conjunction therewith. Such identical component parts are designated in FIG. 6A which are the same reference numerals utilized in FIG. 6 but are differentiated therefrom by means of a prime (') designation.

The clamping apparatus 40A differs from the clamping apparatus 40 in that it is provided with a guide roller 61 which guides the chain through the clamping mechanism 52' and into the slotted pulley 43'. This assures that the chain will be properly oriented relative to the component parts of the clamping mechanism 52' regardless of the angular orientation of the chain relative to the angular orientation of the mooring line.

Referring again to FIG. 1, each mooring attachment pendant 24 may have one or more adjustment pendants 64 secured thereto depending upon the length of the associated preset mooring line 30 and the depth of the ocean at the venue comprising the location of the VTBM 22. A chain 66 is secured to the distal end of the mooring attachment pendant 24 and any adjustment pendants connected thereto. The mooring attachment pendant 24, any adjustment pendants 64 connected thereto, and the chain 66 comprise a pendant 67 which is broadly defined to include all of the components connected between the padeye 26 of the VTBM 22 and the clamping apparatus 40.

The chain 66 extends through the clamping mechanism of the clamping apparatus 40 and around the pulley 43 thereof. A submersible buoy 68 is secured to the distal end of the chain 66.

The apparatus for offshore mooring 20 further including a large anchor handling vessel 80. The vessel 80 is provided with a winch 82. A line 84 extends from the winch 82 and is secured to the pendant 67. As is indicated by the arrows 86, the winch 82 of the vessel 80 is utilized to apply an upwardly directed force of the distal end of the chain 66 thereby applying increasing tension to the pendant 67 and to the preset mooring line 30.

The vessel 80 also deploys an ROV 90. After the winch 82 of the vessel 80 has applied the predetermined tension to the pendant 67 and to the preset mooring line 30, the ROV 90 actuates the clamping mechanism of the clamping apparatus 40 to move the either chain stopper 47, or the stopper arm 54, or the stopper arm 54' into engagement with the chain 66. In this manner the pendant 67 is securely clamped to the preset mooring line while maintaining the predetermined tension throughout the entire connection between the VTBM 22 and the anchor 32. After the clamping mechanism has been actuated to securely clamp the pendant 47 into engagement with the mooring line 30, the ROV 90 disengages the line 84 from the submersible buoy 68.

Figure 2:
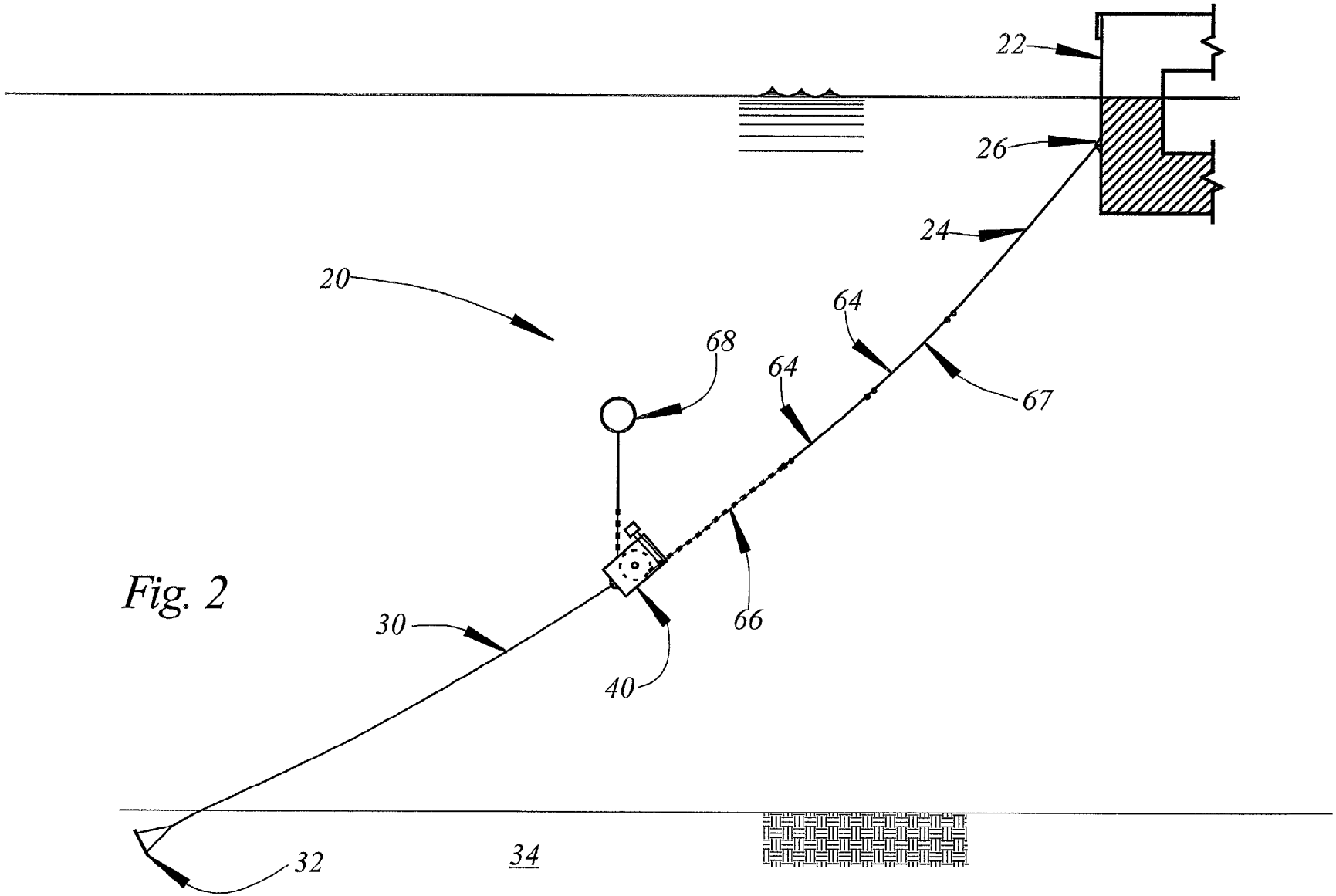
FIG. 2 is an illustration similar to FIG. 1 showing the apparatus thereof at the completion of a mooring installation.

The configuration of each of the mooring lines 30, the clamping apparatus 40 connected thereto, and the associated pendant 67 at the conclusion of mooring operations is illustrated in FIG. 2. The distal end of the chain 66 is maintained in a vertical orientation by the submersible buoy 68. This allows re-engagement of the pendant 67 by a line extending from an anchor handling vessel in the event that an adjustment in the tension that is applied to the VTBM by one or more of the mooring lines attached thereto is required.

As will be appreciated by those skilled in the art, proper mooring of the VTBM 22 typically requires a plurality of pendants and associated preset mooring lines. Mooring of the VTBM 22 is accomplished by actuating the chain 66 comprising each of the pendants to apply the required tension thereto. After tension has been applied to all of the pendants extending from a particular VTBM, further adjustments in the tensioning of particular pendants may be required. After all of the pendants and the associated preset mooring lines connected to the VTBM have been properly tensioned, the vessel 80 departs and the VTBM 22 remains securely moored.

A more complete understanding of the method of offshore mooring 20 comprising the present invention may be had by reference to FIGS. 7 through 15, inclusive.

A plurality of preset mooring lines 30 are installed at spaced apart locations around a mooring venue. Each preset mooring line 30 includes an anchor 32 which is securely engaged with the sea floor 34, and extends from the anchor 32 along the surface of the sea floor 34 to a clamping apparatus 40. A recovery pendant 92 is initially secured to the clamping apparatus 40 and is maintained in a vertical orientation by a submersible buoy 94.

A vessel 80 is maneuvered above the location of the clamping apparatus 40. A line 96 is extended downwardly from the vessel 80 as indicated by the arrows 98. An ROV 90 is deployed from the vehicle 80 and is utilized to secure the line 96 into engagement with the recovery pendant 92.

Figure 8:
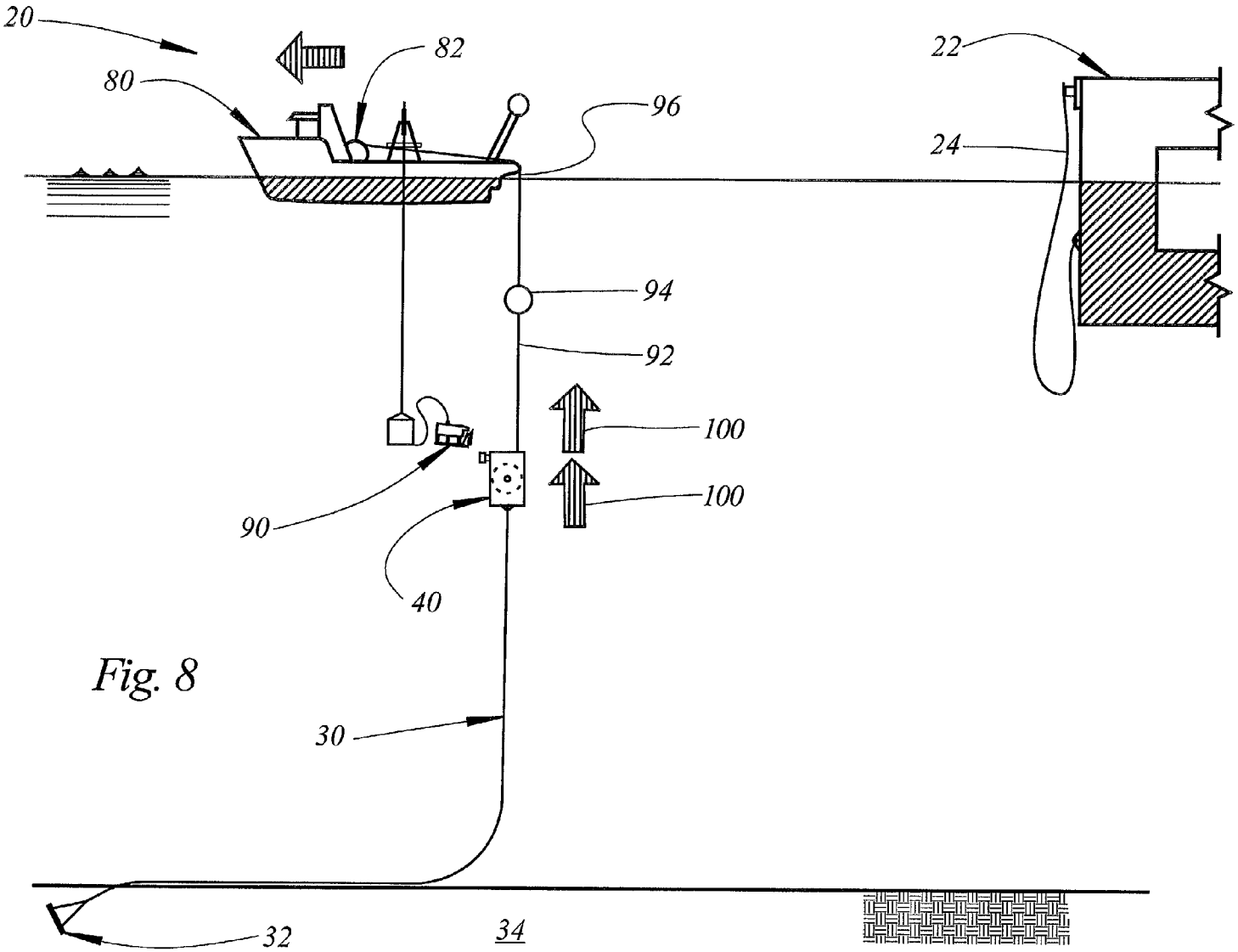
FIG. 8 is a diagrammatic illustration of a later step in the method of FIG. 7.
Figure 9:
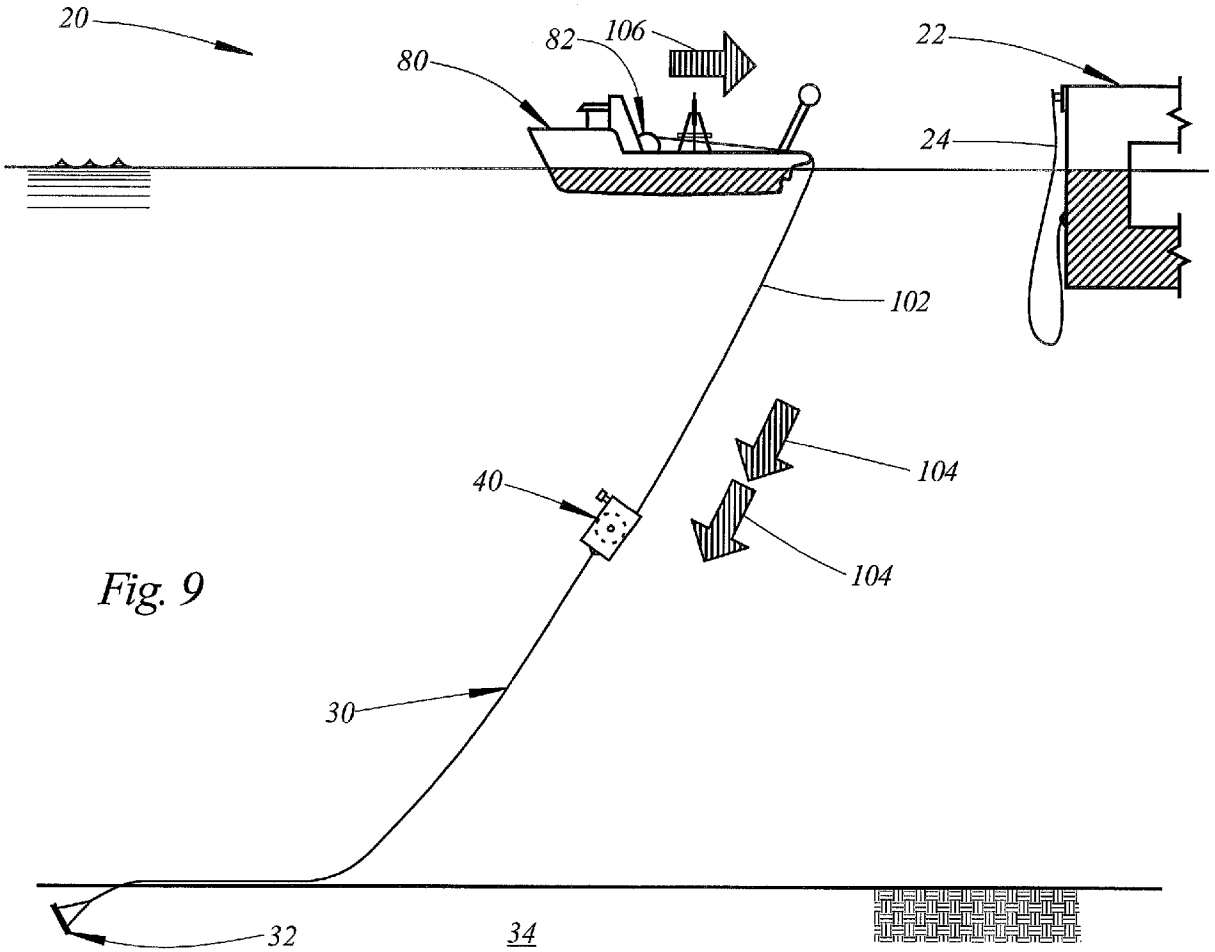
FIG. 9 is a diagrammatic illustration of a later step in the method of FIGS. 7 and 8.

Referring to FIGS. 8 and 9, the line 96 is utilized to bring the clamping apparatus 40 on board the vessel 80. A line 102 is secured to the clamping apparatus 40. The line 102 is paid out in the manner indicated by the arrows 104 as the vessel 80 moves toward a VTBM 22 as indicated by the arrow 106.

Figure 10:
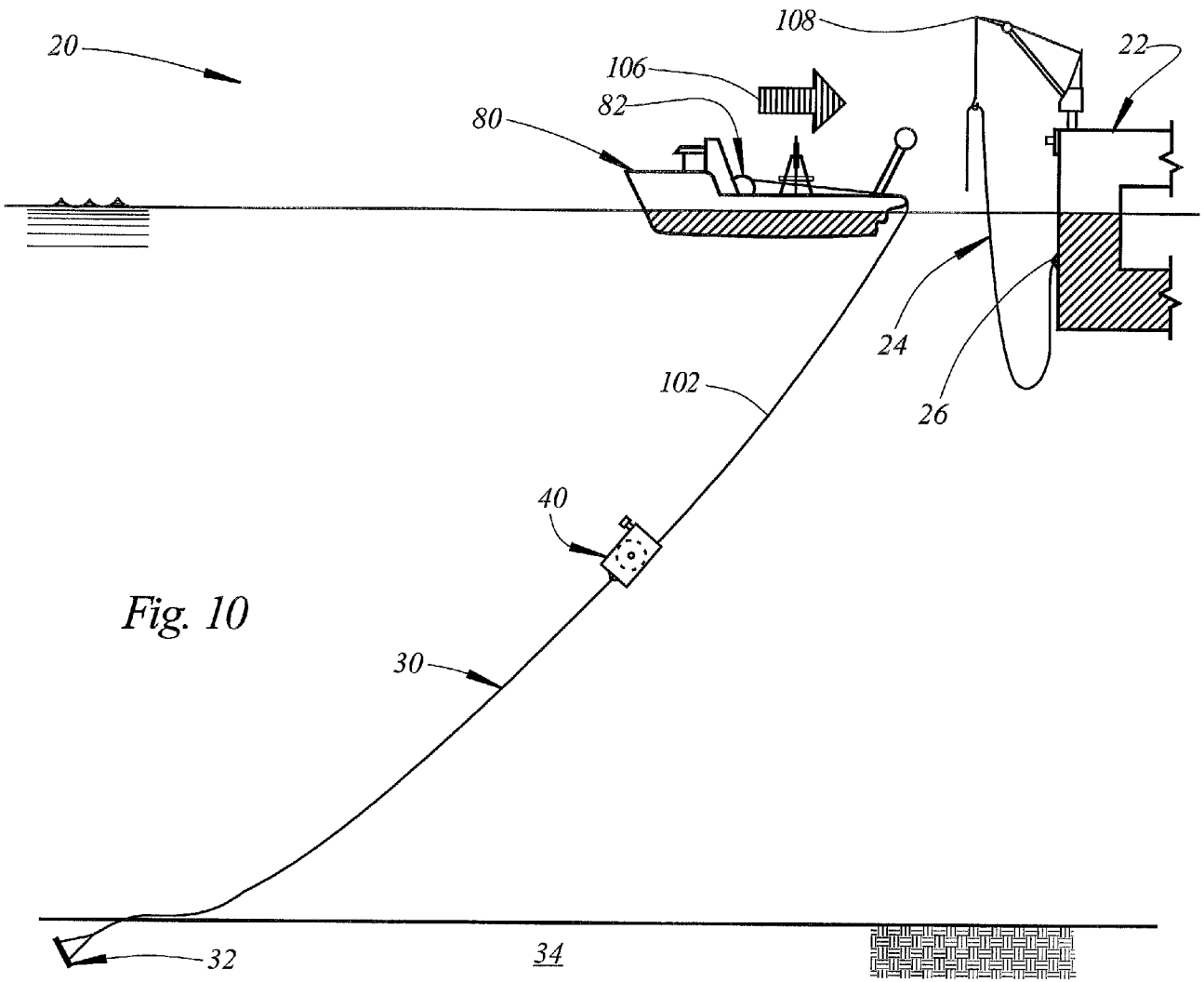
FIG. 10 is a diagrammatic illustration of a later step in the method of FIGS. 7, 8, and 9.

As is shown in FIG. 10, the vessel 80 continues to move toward the VTBM 22 in the direction indicated by the arrow 106. Meanwhile, the line 102 continues to pay out. A crane 108 mounted on the VTBM 22 passes a mooring attachment pendant 24 associated with the mooring line 30 to the vessel 80.

Figure 11:
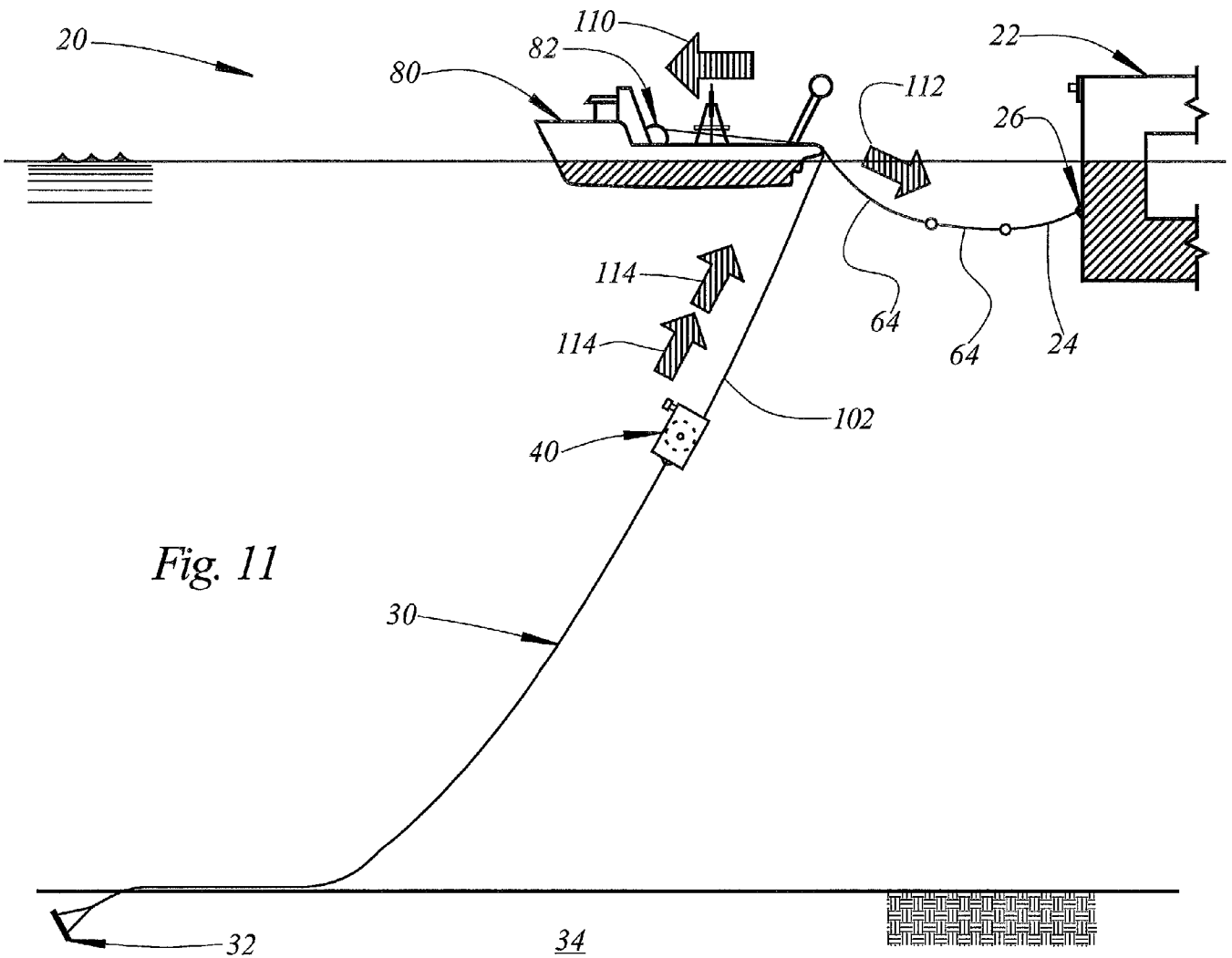
FIG. 11 is a diagrammatic illustration of a later step of the method illustrated in FIG. 7, 8, 9, and 10.

Referring to FIG. 11, the vessel 80 next moves away from the VTBM 22 as indicated by the arrow 110. Adjustment pendants 64 are connected to the mooring pendant 24 as needed and are paid out as indicated by the arrow 112. The line 102 is drawn on board the vessel 80 as indicated by the arrows 114, thereby moving the clamping apparatus 40 upwardly.

Figure 12:
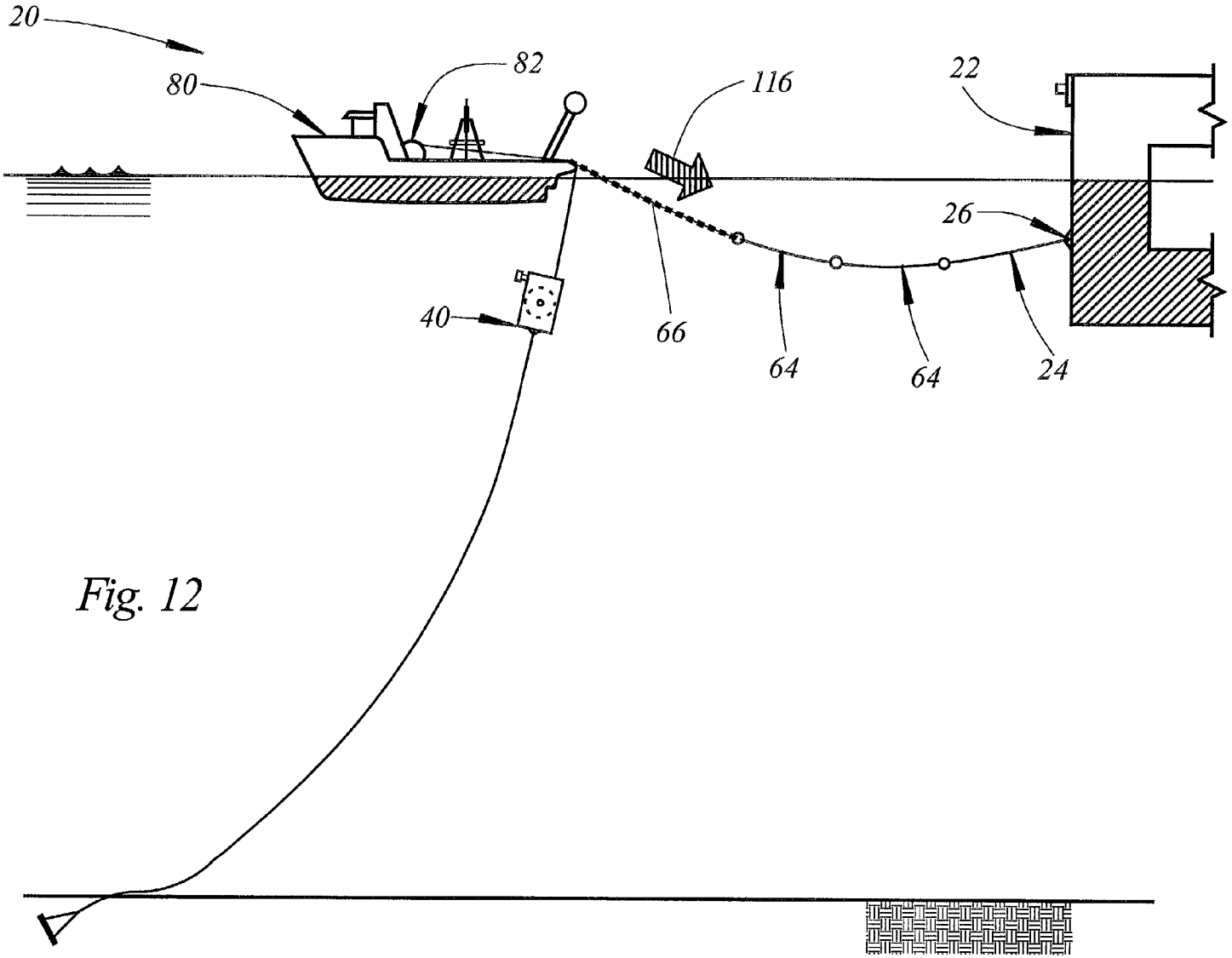
FIG. 12 is an illustration of a later step in the method of the invention illustrated in FIGS. 7, 8, 9, 10, and 11.

As is shown in FIG. 12, a chain 66 is connected to the distal end of the pendant 24, it being understood that one or more adjustment pendants 64 may be connected between the chain 66 and the pendant 24. The chain 66 is paid out from the vessel 80 as indicated by the arrow 116.

Figure 13:
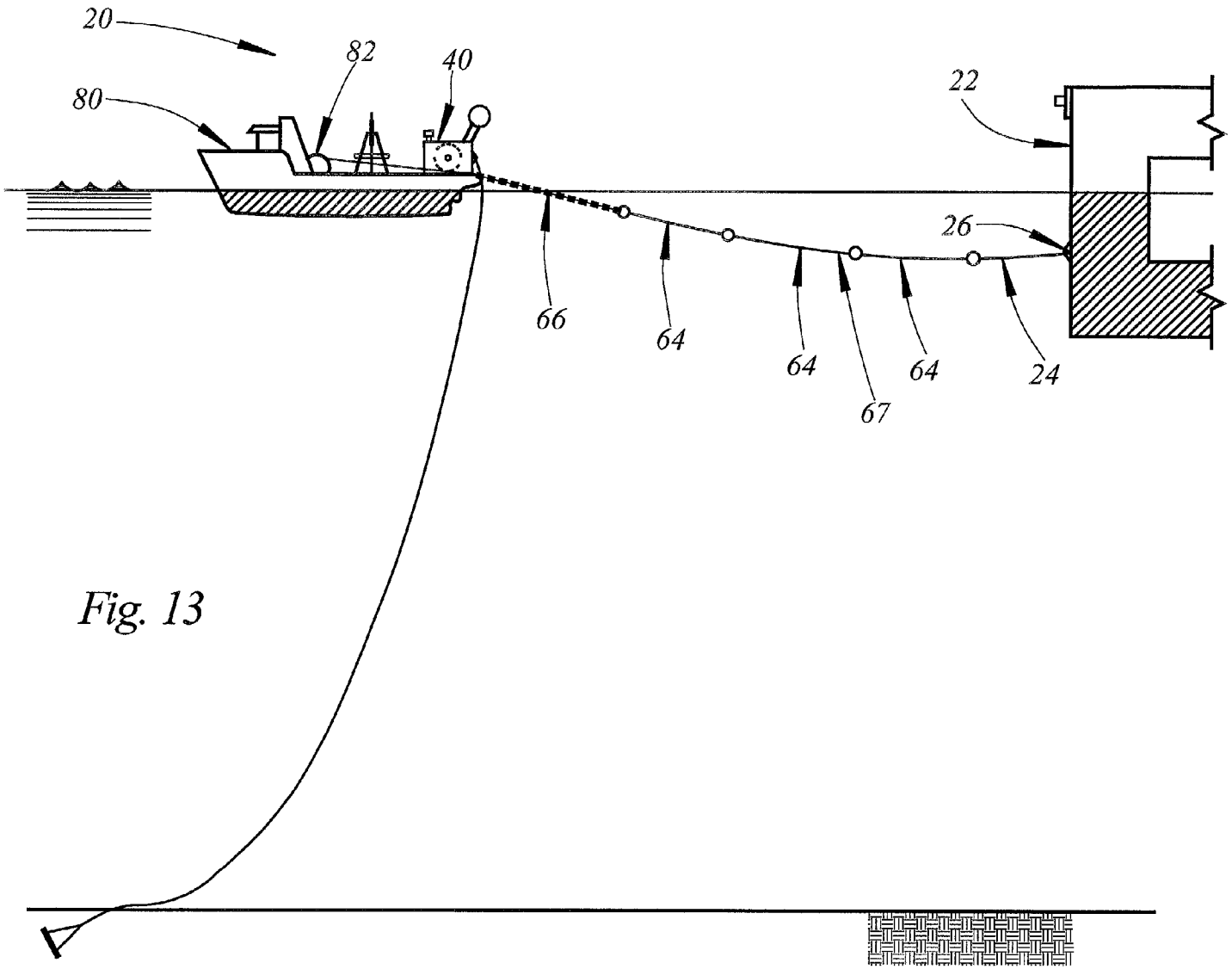
FIG. 13 is an illustration of a later step in the method illustrated in FIGS. 7, 8, 9, 10, 11, and 12.
Figure 14:
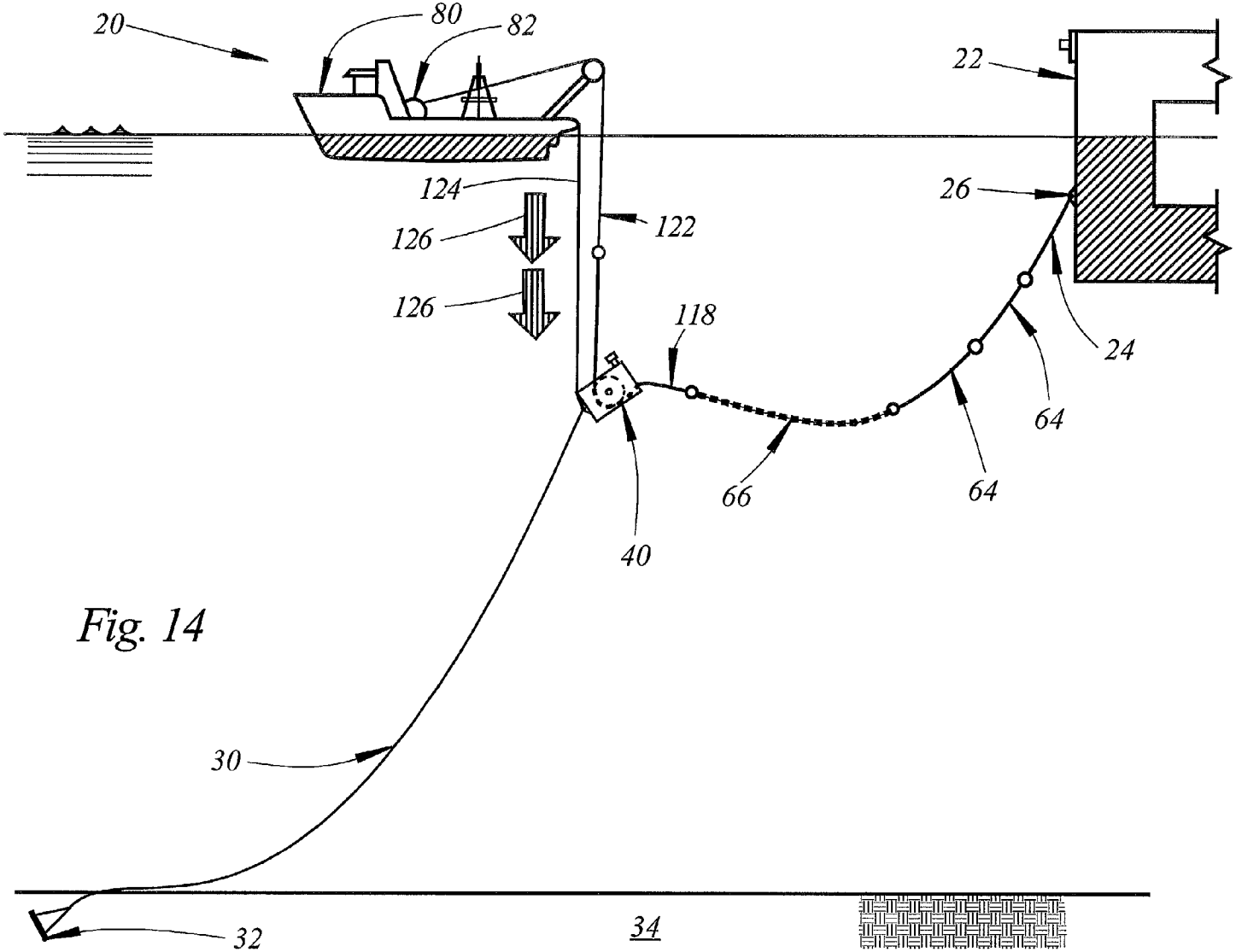
FIG. 14 is a diagrammatic illustration of a later step in the method illustrated in FIGS. 7, 8, 9, 10, 11, 12, and 13.
Figure 15:
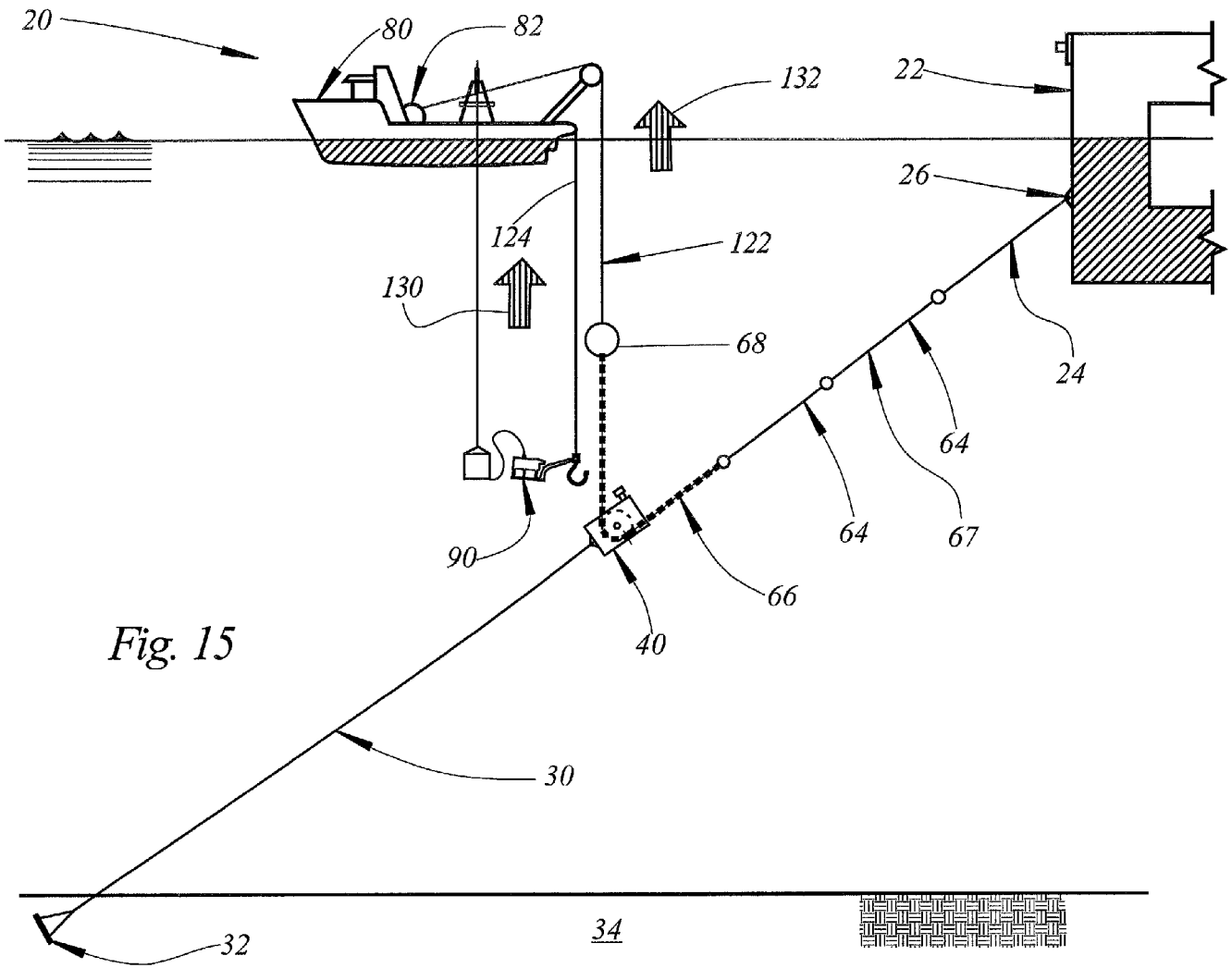
FIG. 15 is a diagrammatic illustration of the concluding steps of the method illustrated in FIGS. 7 through 14, inclusive.

Referring to FIGS. 13 and 14, the clamping apparatus 40 is brought on board the vessel 80. A line 118 is extended through the clamping apparatus 40 while the clamping apparatus 40 is on board the vessel 80. The distal end of a line 118 is in turn connected to a line 122 extending from a winch on board the vessel 80. A line 124 is connected to the clamping apparatus 40 and is utilized to lower the clamping apparatus as indicated by the arrows 126.

Lowering of the clamping apparatus 40 continues until the chain 66 passes through the clamping apparatus 40. At this point the lines 122 and 124 are recovered onto the vessel 80 until the clamping apparatus 40 and the chain 66 extending therethrough are either adjacent to or on board the vessel 80. A submersible buoy 68 is then inserted at the distal end of the chain 66. The lines 122 and 124 are then paid out until the clamping apparatus 40 and the chain 66 are positioned as shown in FIG. 11.

The ROV 80 is then employed to disengage the line 124 from the clamping apparatus 40. The line 124 is recovered on board the vessel 80 as indicated by the arrow 130. The winch 82 on board the vessel 80 applies an upwardly directed force to the chain 66 as indicated by the arrow 132. When the predetermined tension has been applied to the pendant and the preset mooring line, the ROV 80 is utilized to actuate the clamping apparatus 40 to securely clamp the pendant to the preset mooring line while maintaining the predetermined tension thereon. The ROV 80 is thereafter utilized to disengage the line 122 from the chain 66.

Figure 16:
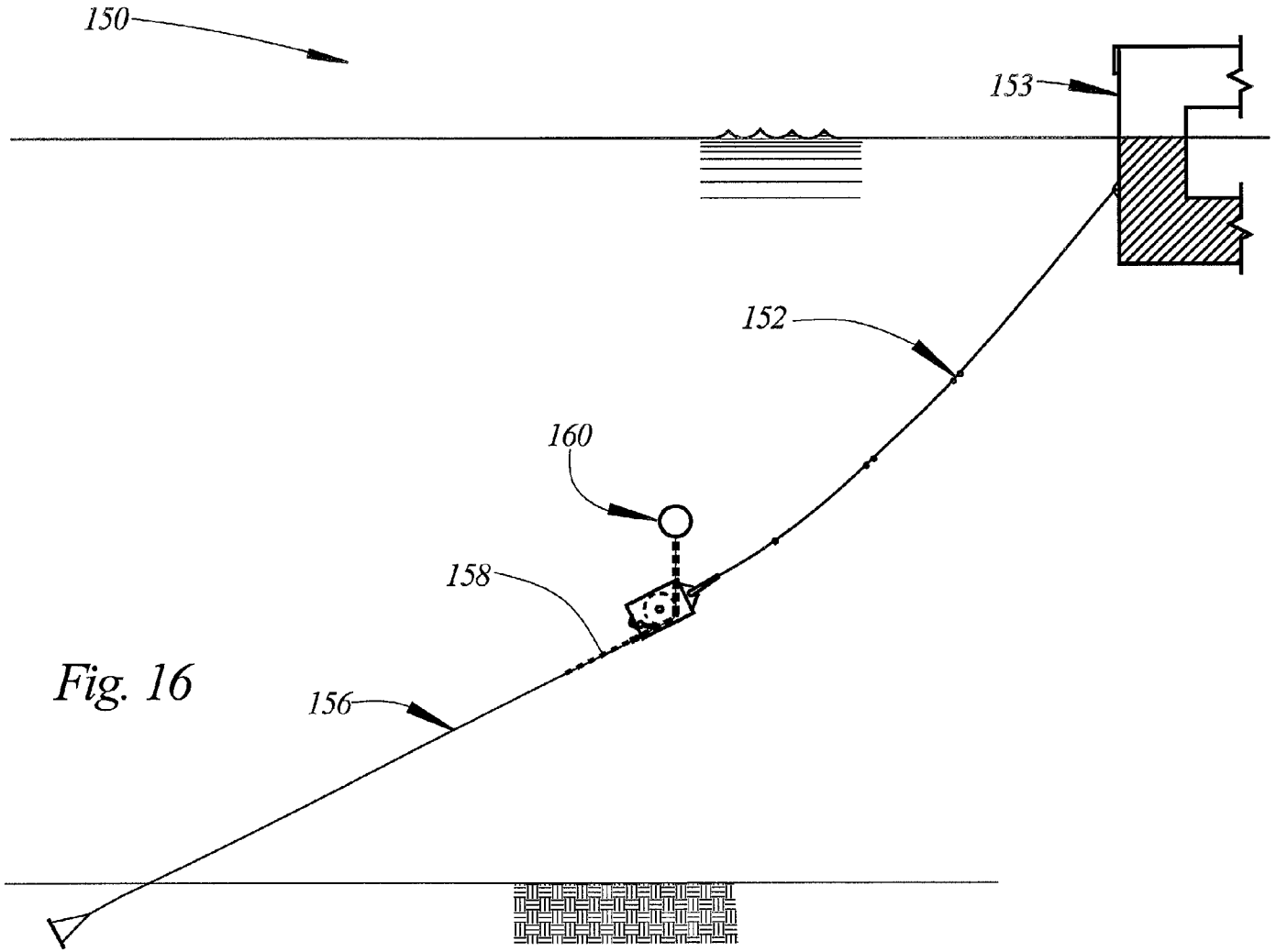
FIG. 16 is a diagrammatic illustration of a method of and apparatus for offshore mooring comprising a second embodiment of the invention.

Referring to FIG. 16, there is shown a method of and apparatus for offshore mooring 150 comprising a second embodiment of the invention. In accordance with the second embodiment of the invention, a pendant 152 extends from a vessel to be moored (VTBM) 153 and is secured to a clamping apparatus 154. The pendant 152 is substantially identical to the pendant 67 illustrated in FIGS. 1 through 15, inclusive, and described hereandabove in conjunction therewith, except that the pendant 152 does not necessarily have a chain secured at its distal end. The clamping apparatus 154 is substantially identical in construction and function to the clamping apparatus 40 as illustrated in FIGS. 3 through 6, inclusive, and includes a clamping mechanism such as the clamping mechanism 46 shown in FIGS. 3 and 5, or the clamping mechanism 52 shown in FIG. 6, or the clamping mechanism 52' of FIG. 6A.

A mooring line 156 extends from a suitable anchor (not shown in FIG. 16). The mooring line 156 is substantially identical in construction and function to the mooring line 30 as illustrated in FIGS. 1 through 15, inclusive, except that the mooring line 156 has a chain 158 secured to the distal end thereof. A submersible buoy 160 is secured to the distal end of the chain 158.

As will be appreciated by those skilled in the art, the deployment and function of the method of and apparatus for offshore mooring 150 comprising the second embodiment of the invention are substantially identical to the deployment and operation of the method of and apparatus for offshore mooring 20 comprising the first embodiment of the invention. The first and second embodiments of the invention differ primarily in the fact that the clamping apparatus 154 of the second embodiment of the invention is secured to the pendant 152 as opposed to being secured to the mooring line. This in turn causes the tensioning force to be applied by an anchor handling vessel to a chain secured at the distal end of the mooring line and extending through the clamping mechanism and around the slotted sheave of the clamping apparatus 154.

Referring to FIGS. 17 through 20, inclusive, there is shown an apparatus for offshore mooring 190 comprising a third embodiment of the invention. The apparatus 190 comprises a pin 192. The remaining components of the apparatus 190 are rotatably and/or pivotally supported on the pin 192. The apparatus 190 further includes a slotted pulley or sheave 194 which is rotatably supported on the pivot pin 192. The slotted pulley 194 includes an inner narrow slot 196 which receives the nominally vertically oriented links of a chain 198, and an outer wide slot 200 which receives the nominally horizontally oriented links of the chain 198.

The apparatus for offshore mooring 190 further includes an attachment arm 202 which is pivotally supported on the pin 192. A shackle 204 is mounted at one end of the attachment arm 202, and a shackle 206 is mounted at the opposite end thereof. The shackle 204 is utilized whenever it is necessary to raise or lower the apparatus for offshore mooring 190 relative to an anchor handling vessel. In such instances a line extending from the anchor handling vessel is secured to the shackle 204 of the apparatus 190 by a remote operated vehicle.

The shackle 206 has a chain 208 connected thereto. When the apparatus for offshore mooring 190 is utilized in conjunction with the method for offshore mooring illustrated in FIGS. 1 through 15, inclusive, and described hereinabove in conjunction therewith, the chain 208 comprises the distal end of the mooring line 30 and the chain 198 comprises the distal end of the pendant 67. In the case of the method of offshore mooring illustrated in FIG. 14 and described hereinabove in conjunction therewith the chain 208 comprises the distal end of the pendant 152 and the chain 198 comprises the distal end of the mooring line 156.

Figure 19:
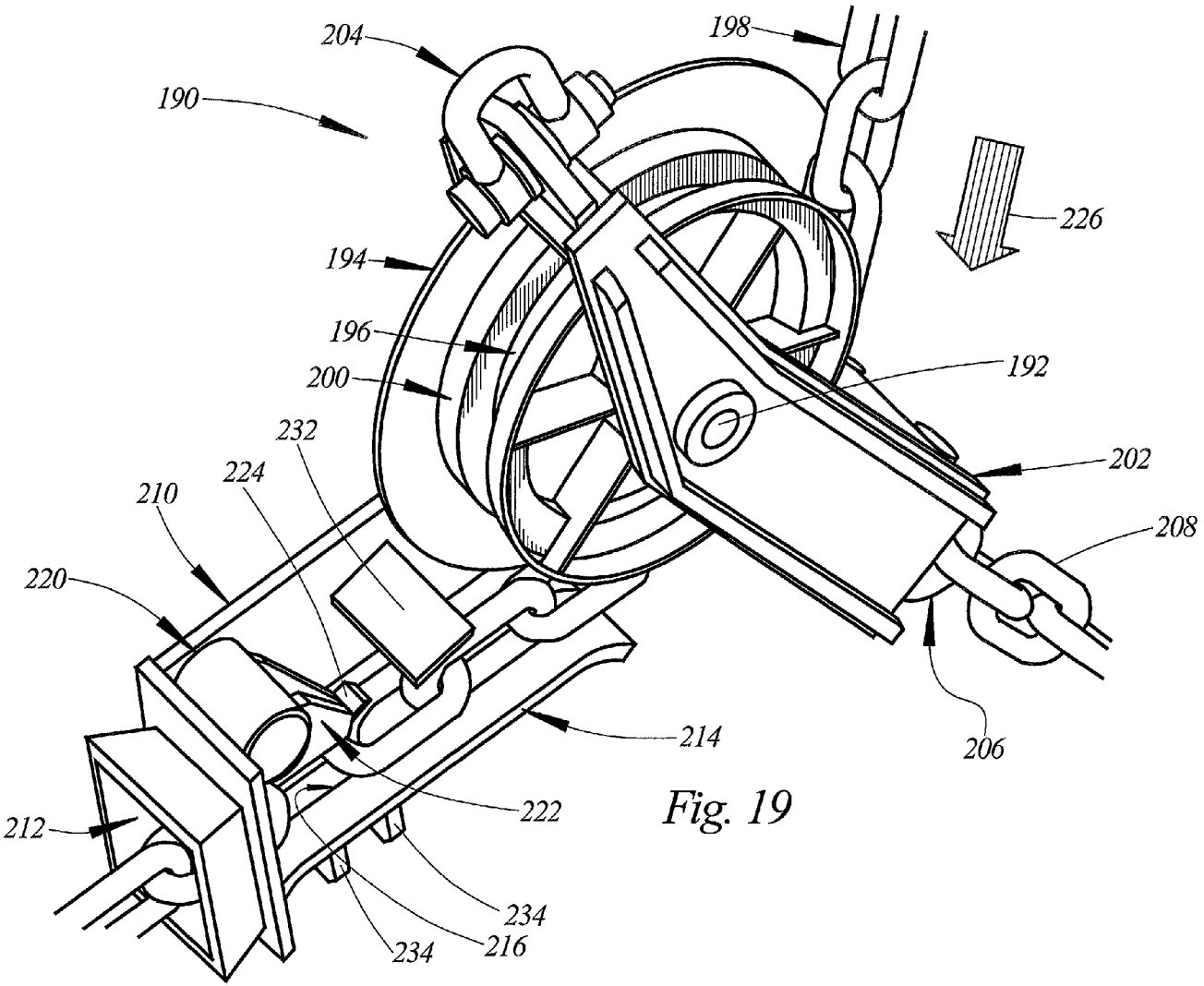
FIG. 19 is a perspective view similar to FIG. 18 in which certain parts have been broken away more clearly to illustrate certain features of the invention.
Figure 20:
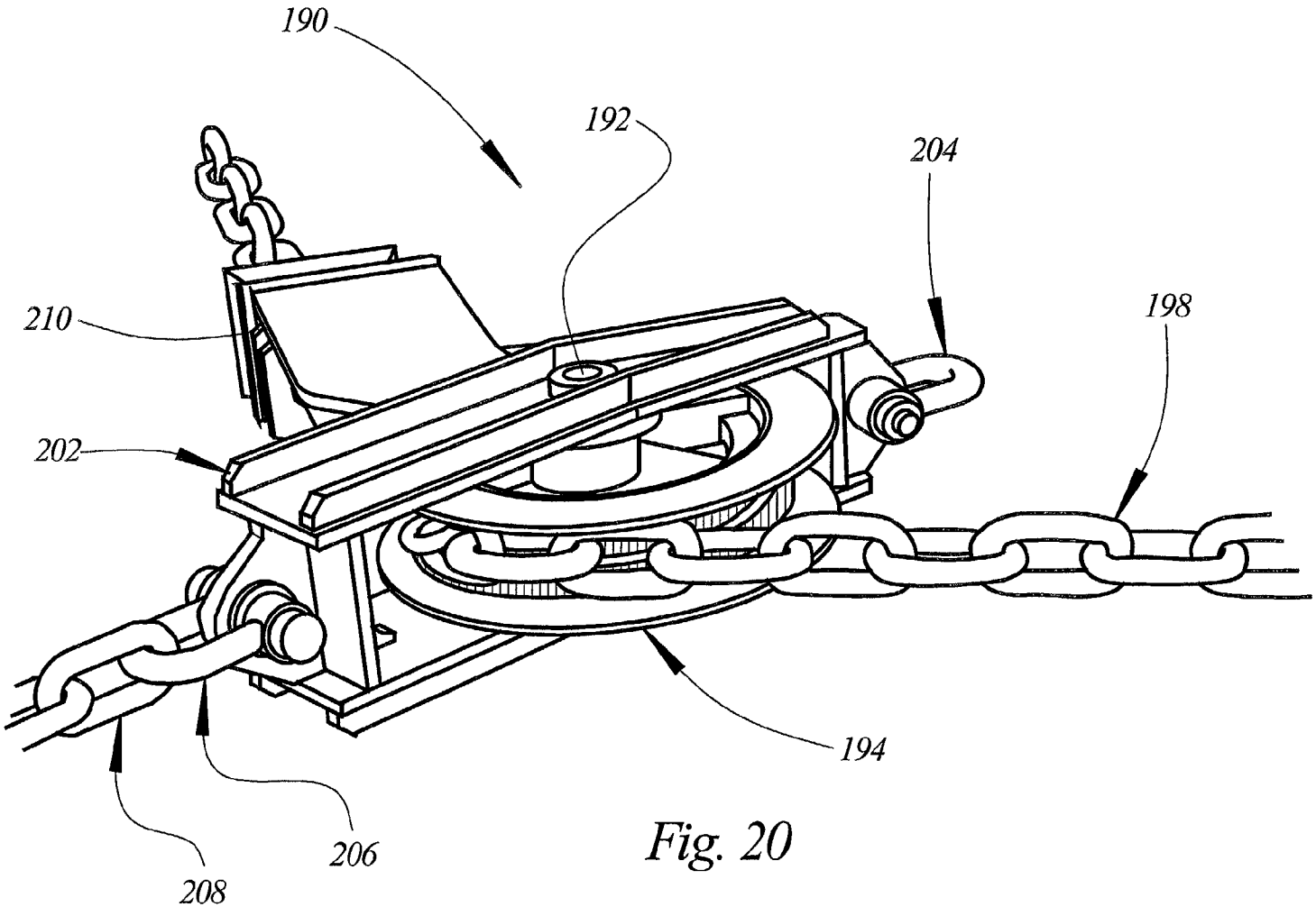
FIG. 20 is a perspective view further illustrating the apparatus of FIG. 17.

The apparatus for offshore mooring 190 further comprises a clamping apparatus 210 which is pivotally supported on the pin 192. Referring particularly to FIG. 19, the clamping apparatus 210 includes a rectangular chain guiding aperture 212 which receives the chain 198 therethrough. The aperture 212 extends to a guide plate 214 having a slot 216 formed therein which receives the nominally vertically oriented links of the chain 198.

Figure 17:
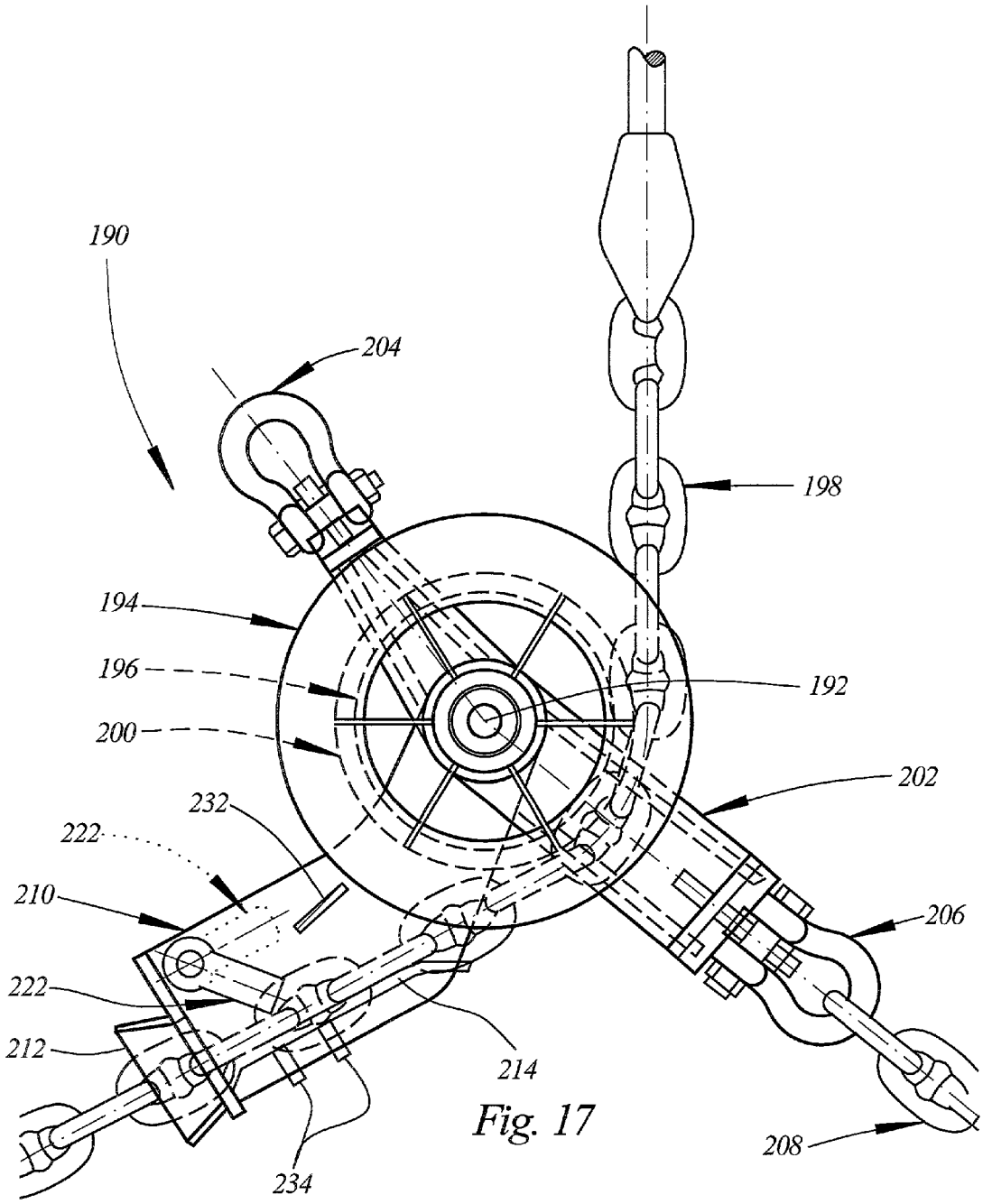
FIG. 17 is a side view illustrating an apparatus for offshore mooring comprising a third embodiment of the invention.

The clamping apparatus 210 further includes a clamping mechanism 220. Referring momentarily to FIG. 17, the clamping mechanism 220 includes a stopper arm 222 which is pivotally supported for movement between the full line position and the dashed line position as shown in FIG. 17. Referring to FIG. 19, the stopper arm 222 has a curved chain engaging plate 224 mounted at the distal end thereof which normally engages one of the nominally vertically oriented links of the chain 198 to prevent movement of the chain 198 in the direction of the arrow 226 (FIG. 19).

Figure 18:
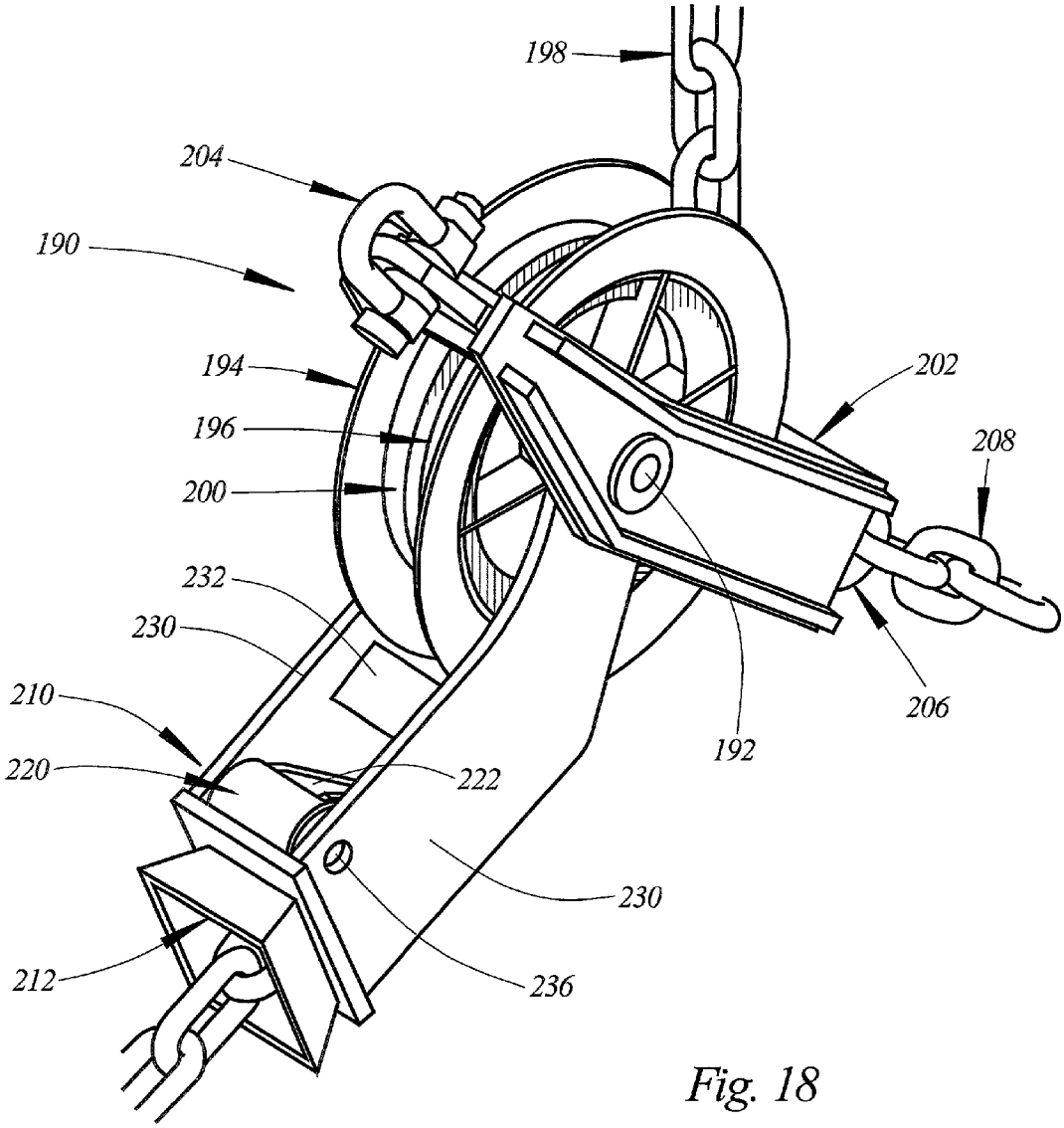
FIG. 18 is a perspective view further illustrating the apparatus of FIG. 17.

Referring to FIGS. 18 and 19, the clamping apparatus 210 comprises spaced parallel plates 230 extending on opposite sides of the slotted pulley 194. The plates 230 are interconnected by a reinforcing member 232 and by reinforcing members 234 which are mounted on the underside of the guide plate 214. An aperture 236 extends through one of the guide plates 230, it being understood that both guide plates 230 may be provided with apertures 236, if desired. The aperture 236 provides access to the stopper arm 222 by a tool mounted on a remote operated vehicle, thereby permitting the remote operated vehicle to selectively pivot stopper arm 222 from the position shown in full lines in FIG. 17 to the position shown in dashed lines therein. In this manner the stopper arm 222 is disengaged from the chain 198 thereby allowing the chain 198 to move in the direction of the arrow 226 (FIG. 19). As will be appreciated by those skilled in the art, the stopper arm 222 is normally retained in the position of the full lines in FIG. 17 by a suitable spring.

Figure 21:
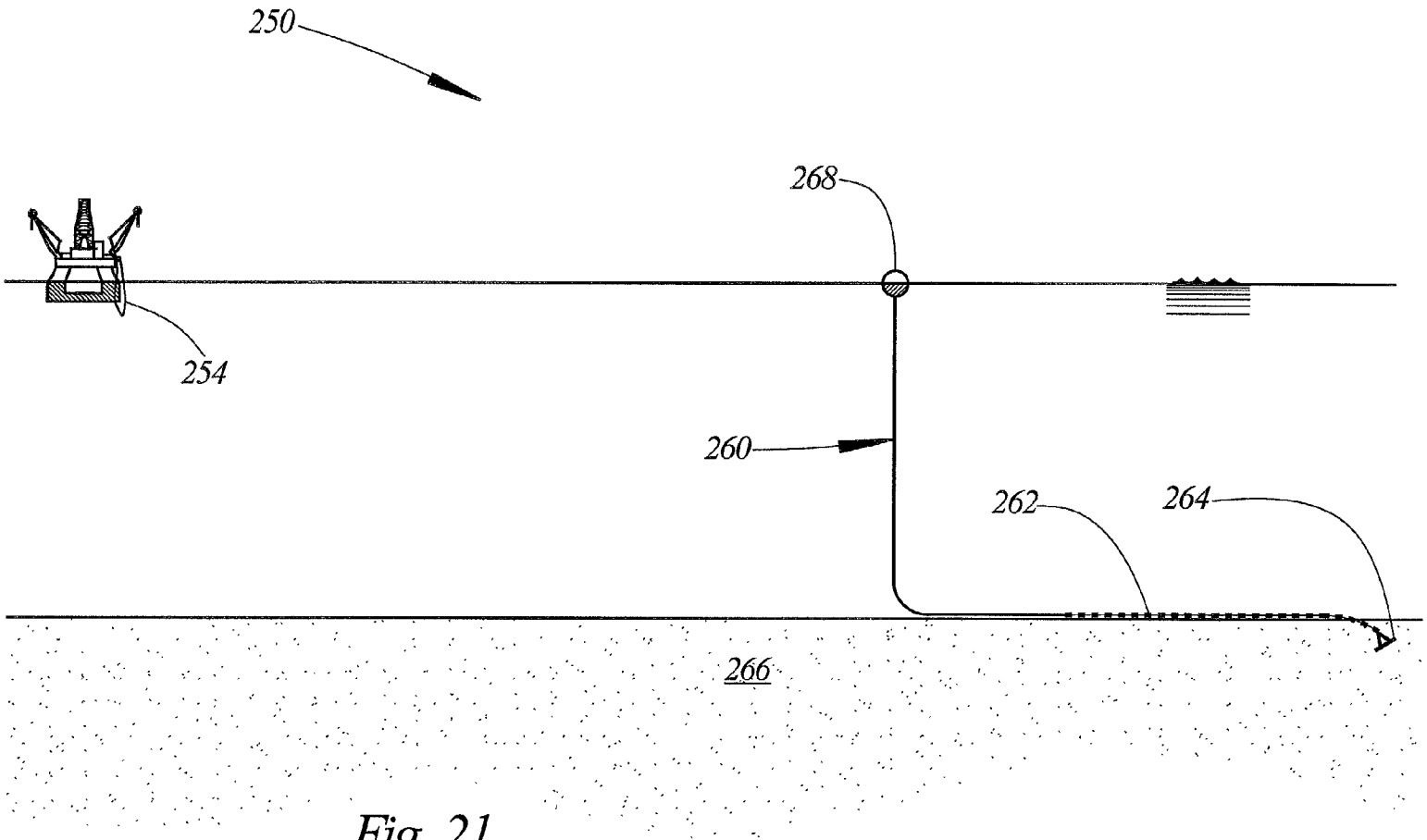
FIG. 21 is a diagrammatic illustration of early steps in a method of offshore mooring comprising a fourth embodiment of the invention.

A method of offshore mooring 250 comprises a fourth embodiment of the invention as illustrated in FIGS. 21 through 31, inclusive. Referring first to FIG. 21, a vessel to be moored (VTBM) 252 is located at an offshore mooring site. Although the VTBM illustrated in FIGS. 21 through 31 is a mobile offshore drilling unit, the method of offshore mooring 250 is equally adapted to the mooring of floating production platforms, SPARs, as well as other vessels requiring offshore mooring. The VTBM 252 has a plurality of connection pendants 254 secured thereto.

A mooring line 260 includes a ground chain 262 which is secured to an anchor 264. The anchor 264 is securely engaged with the sea floor 266 and may comprise a drag embedment anchor, a vertically loaded anchor, a driven pile, a suction anchor, a suction embedded plate anchor, or any other anchor type adapted for mooring in deep waters. A submersible buoy 268 is connected to the distal end of the mooring line 260.

Figure 22:
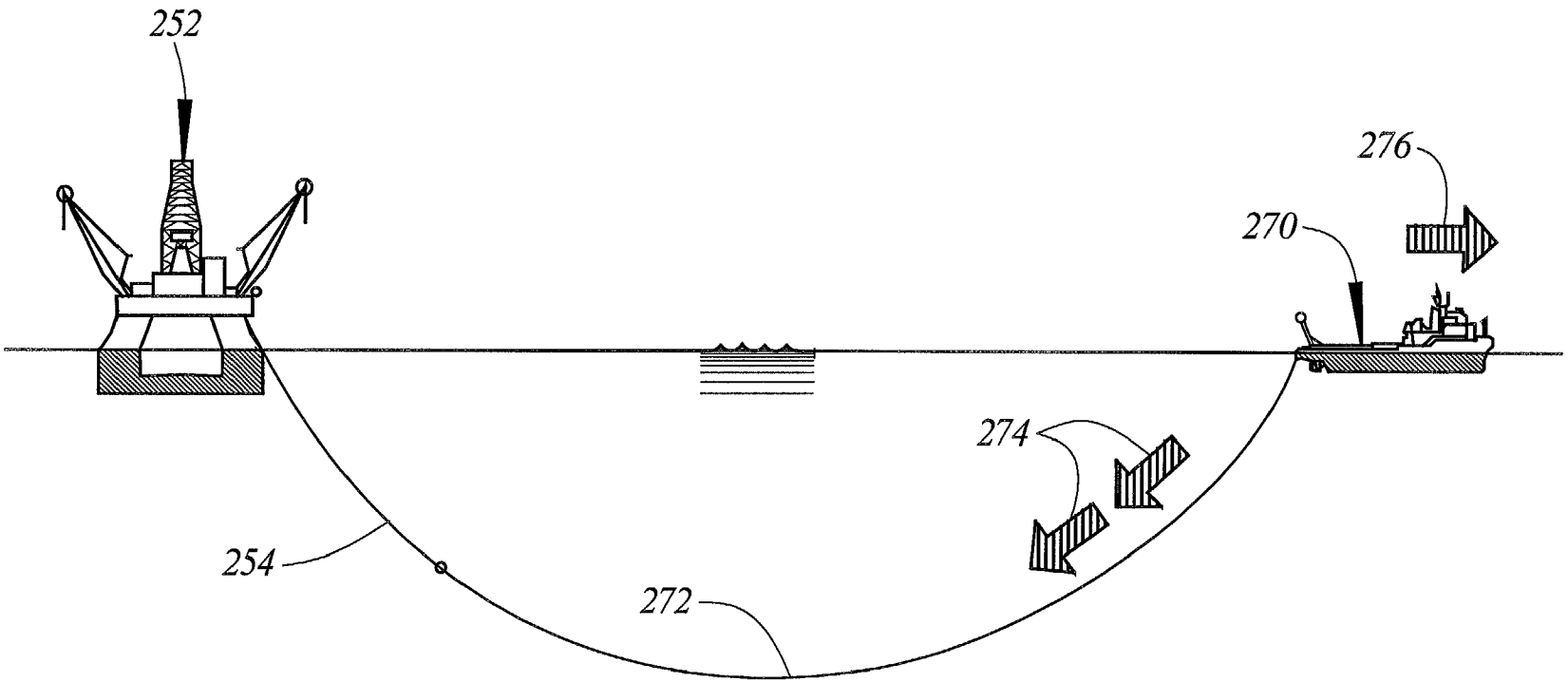
FIG. 22 is a diagrammatic illustration of a later step in the method of FIG. 21.

Referring to FIG. 22, an anchor handling vessel 270 receives the connection pendant 254 from the VTBM 252 and connects an insert wire 272 thereto. The anchor handling vessel 270 pays out the insert wire 272 as indicated by the arrows 274 and moves away from the VTBM 252 as indicated by the arrow 276.

Figure 23:
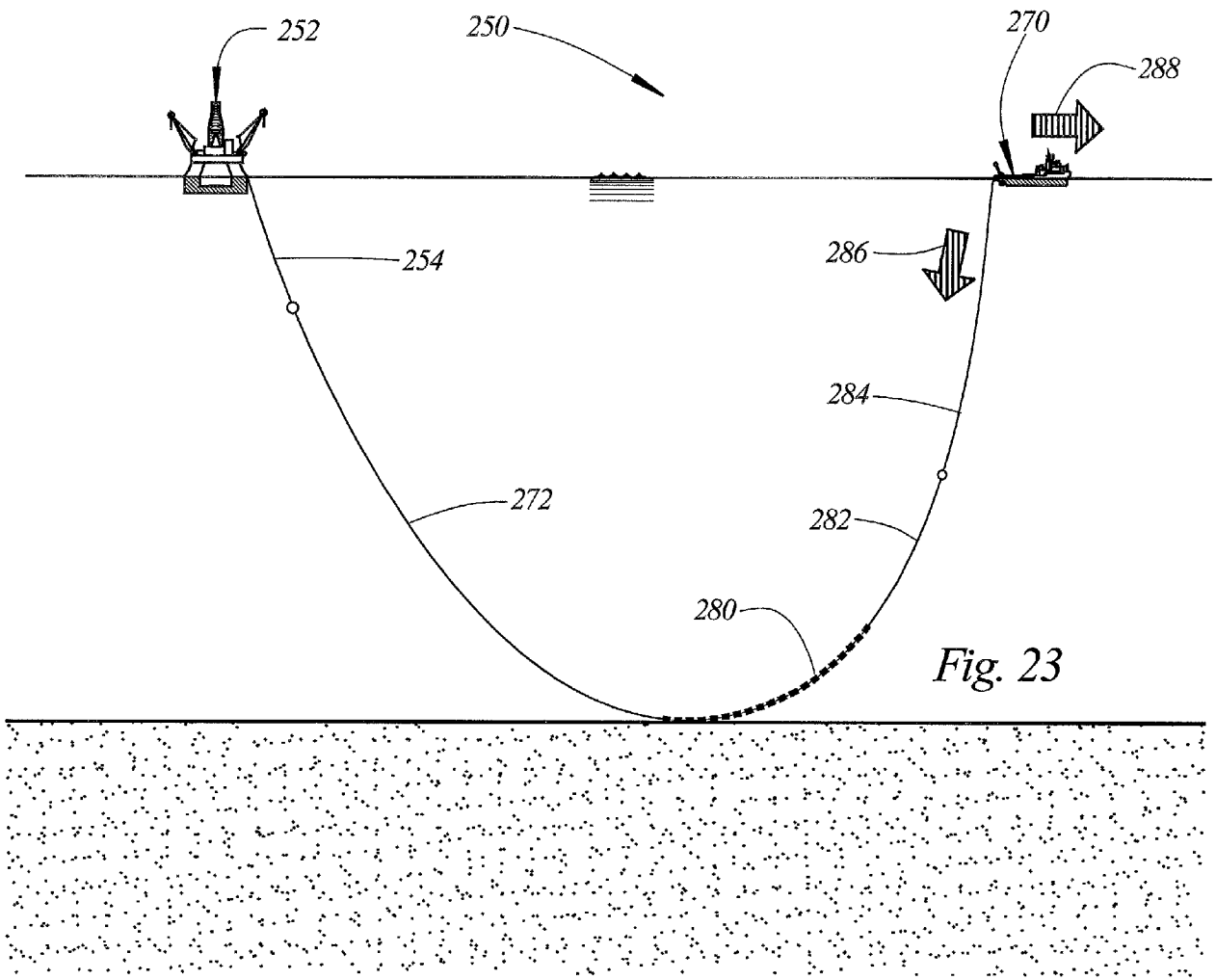
FIG. 23 is a diagrammatic illustration of a later step in the method of FIGS. 21 and 22.

As is shown in FIG. 23, a tensioning chain 280 is inserted between the insert wire 272 and a pendant 282. The pendant 282 is in turn connected to a work wire 284. The work wire 284 is paid out as indicated by the arrow 286 while the anchor handling vessel 270 moves further away from the VTBM 282 as indicated by the arrow 288.

Figure 24:
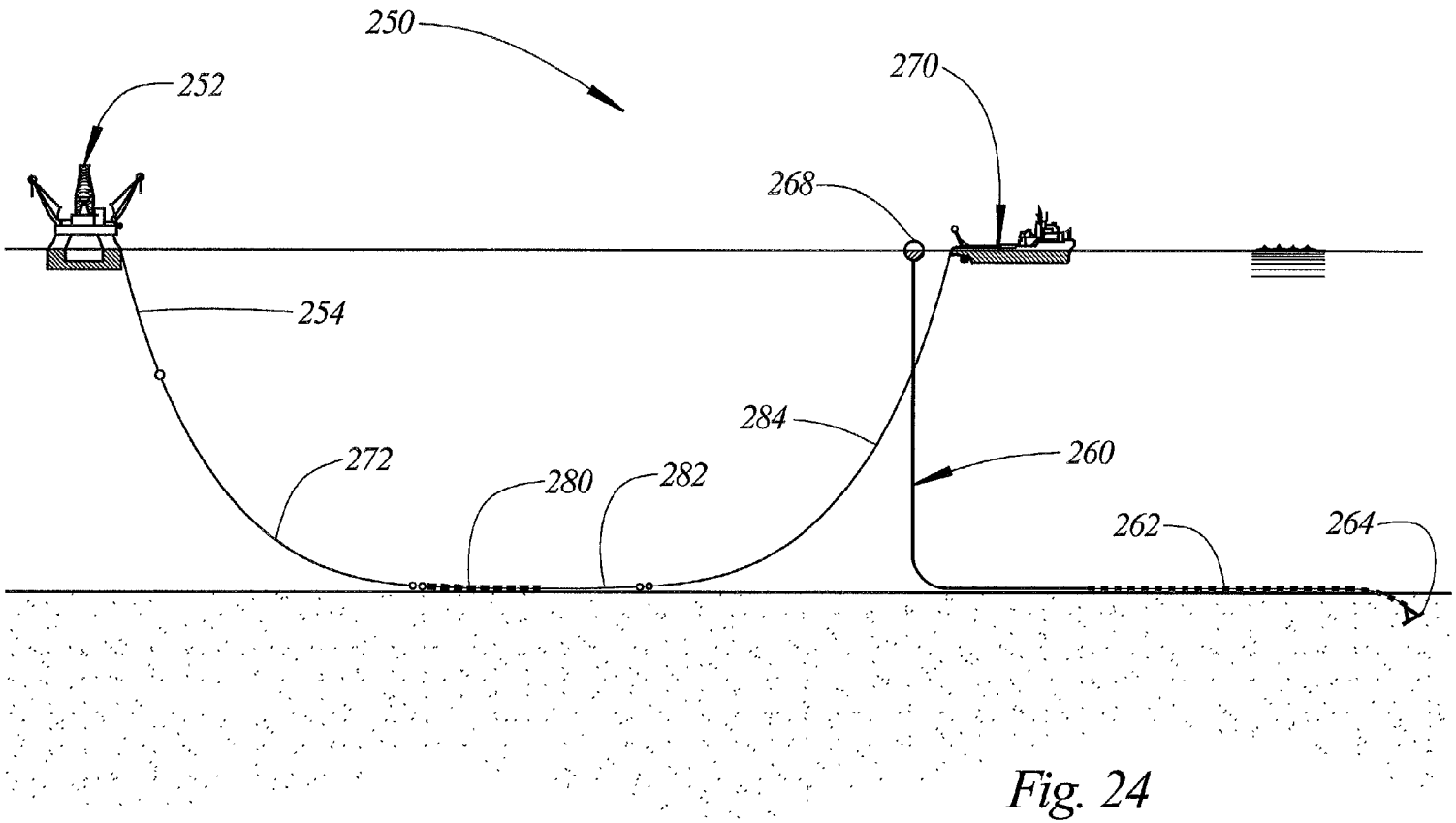
FIG. 24 is a diagrammatic illustration of a later step in the method of FIGS. 21 through 23, inclusive.

Referring to FIG. 24, the anchor handling vessel 270 pays out the work wire 284 until it arrives at the location of the buoy 268. The anchor handling vessel 270 recovers the buoy 268 and secures the distal end of the mooring line 260 in a sharks jaws retainer. The buoy 268 is stored on the anchor handling vessel 270.

Figure 25:
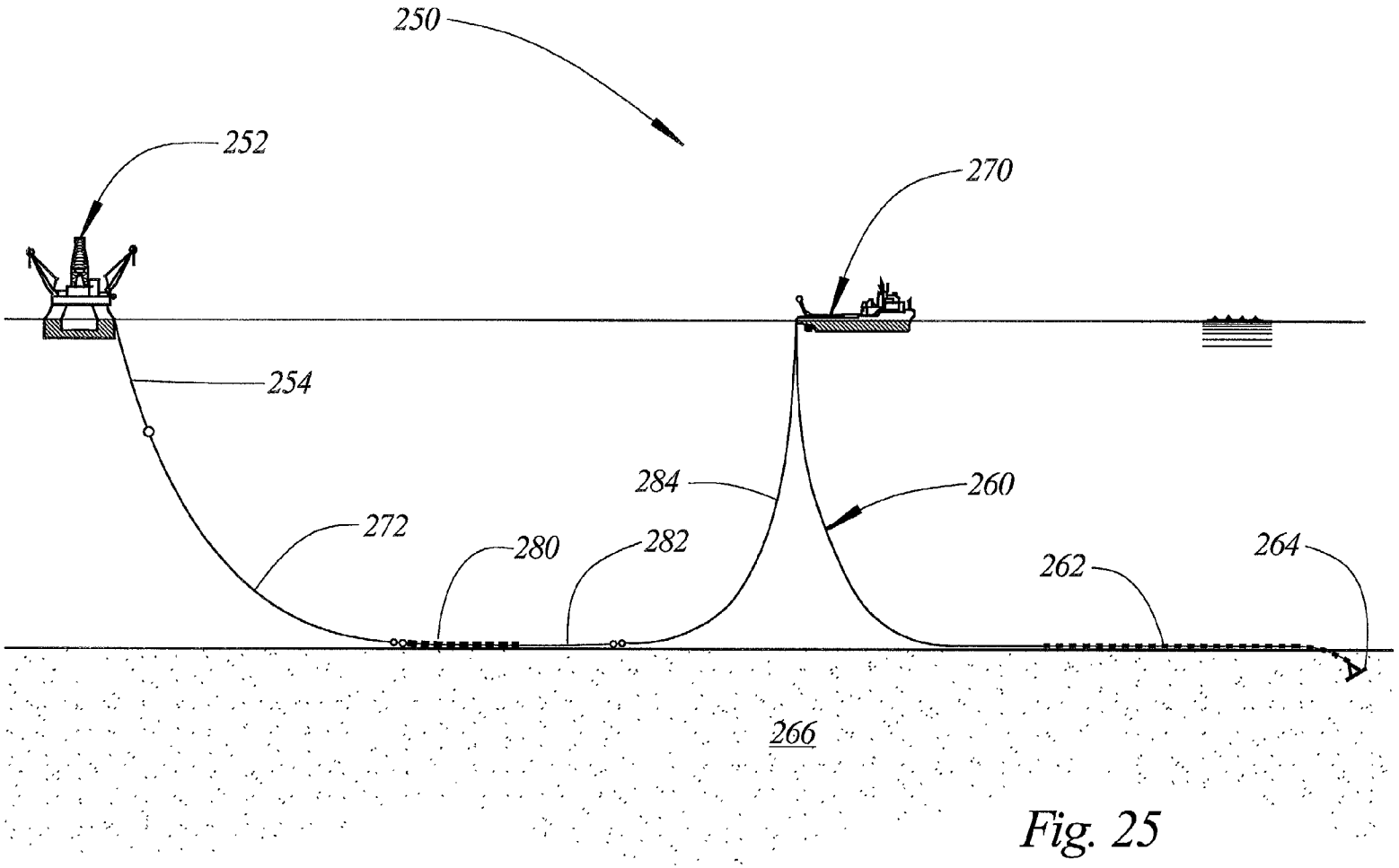
FIG. 25 is a diagrammatic illustration of a later step in the method of FIGS. 21 through 24, inclusive.
Figure 26:
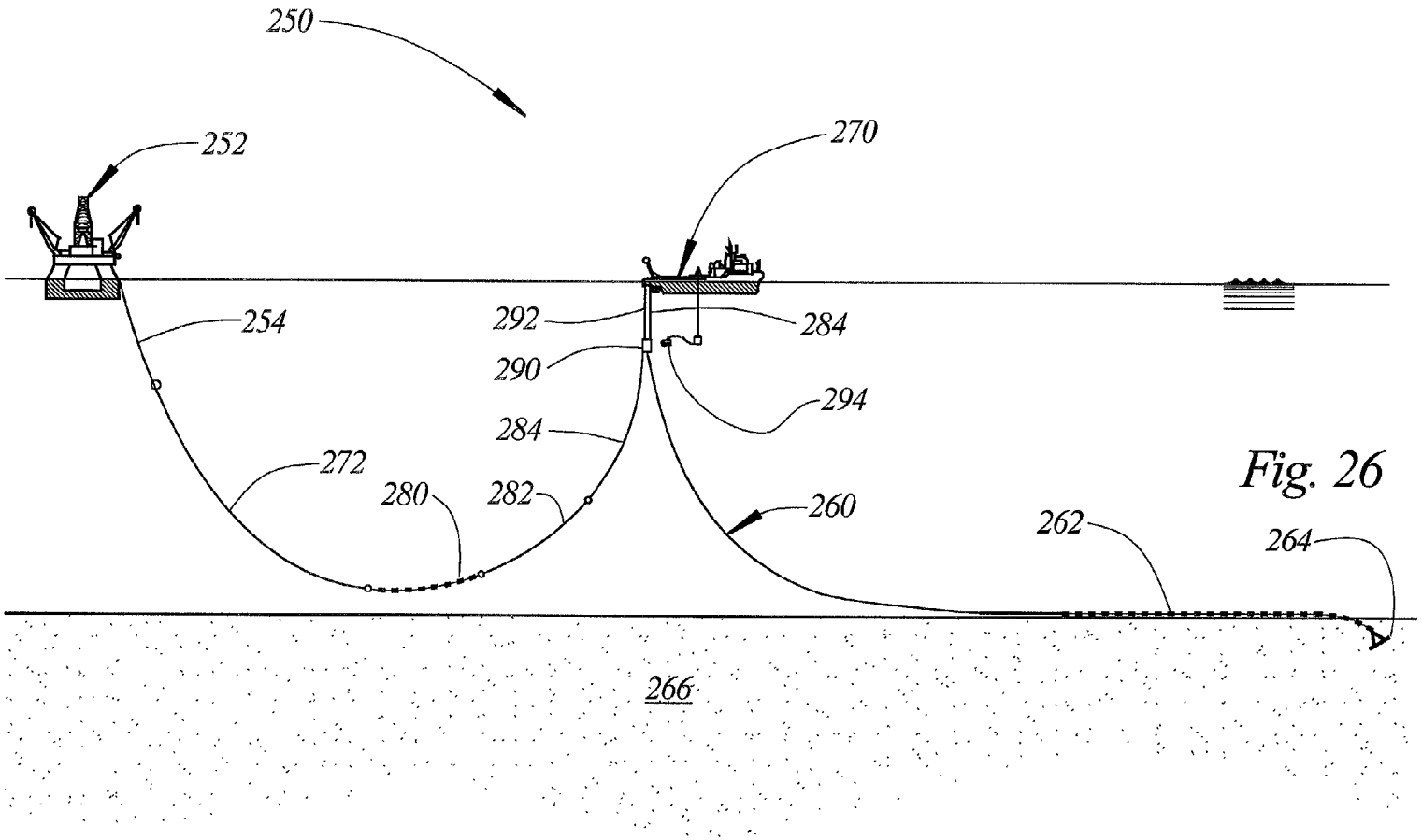
FIG. 26 is a diagrammatic illustration of a later step in the method of FIGS. 21 through 25, inclusive.

As is shown in FIGS. 25 and 26, the distal end of the mooring line 260 is connected to a clamping apparatus 290 constructed in accordance with the present invention. The work wire 284 is extended through the clamping apparatus 290. A line 292 is secured to the clamping apparatus 280 and is utilized to lower the clamping apparatus 290 from the anchor handling vessel 270. A remote operated vehicle (ROV) 294 is deployed from the anchor handling vessel 270 and is utilized to inspect and observe the clamping apparatus 290, the connection of the mooring line 260 thereto and the movement of the work wire 284 through the clamping apparatus 290 as the clamping apparatus 290 moves downwardly.

Figure 27:
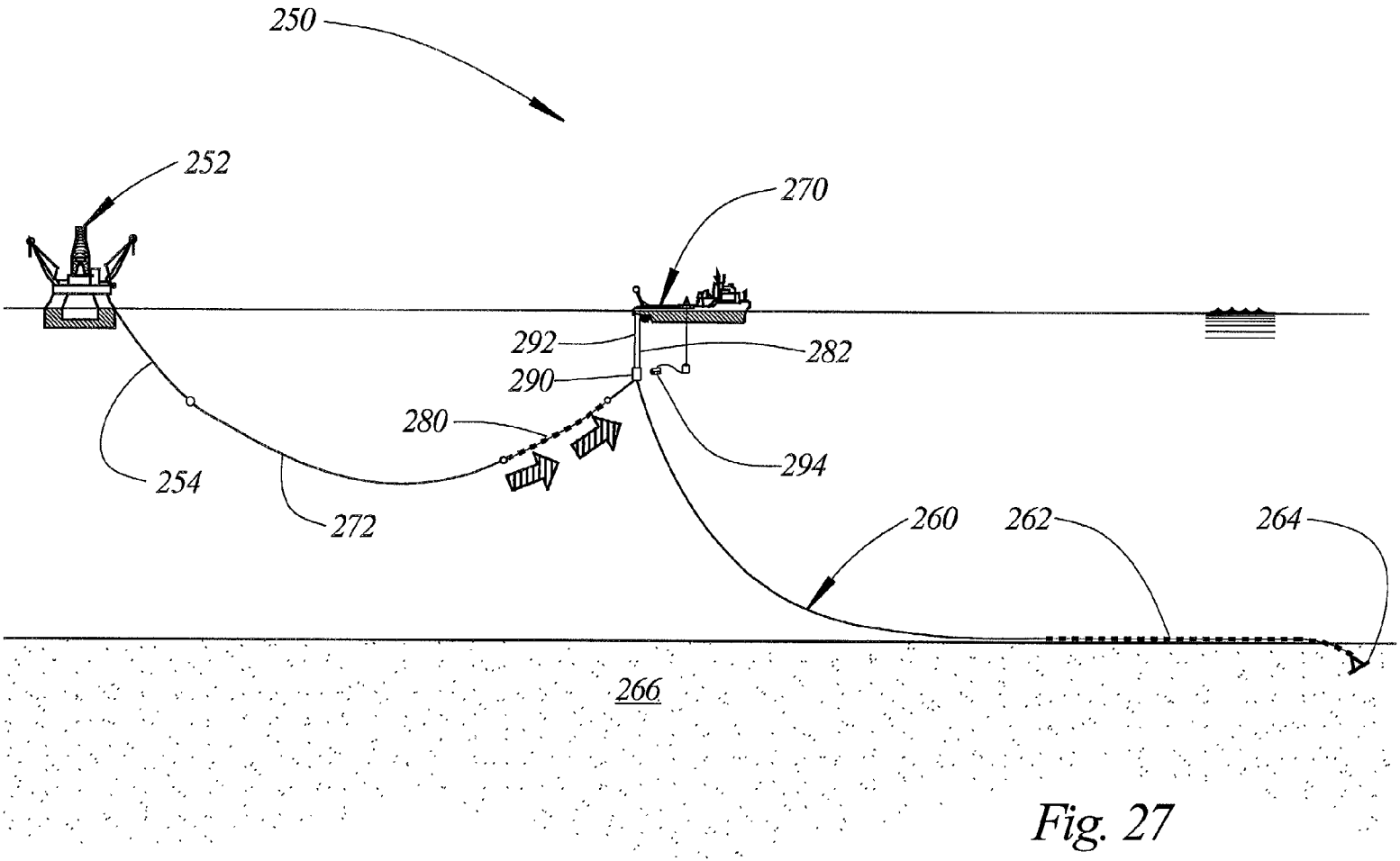
FIG. 27 is a diagrammatic illustration of a later step in the method of FIGS. 21 through 26, inclusive.
Figure 28:
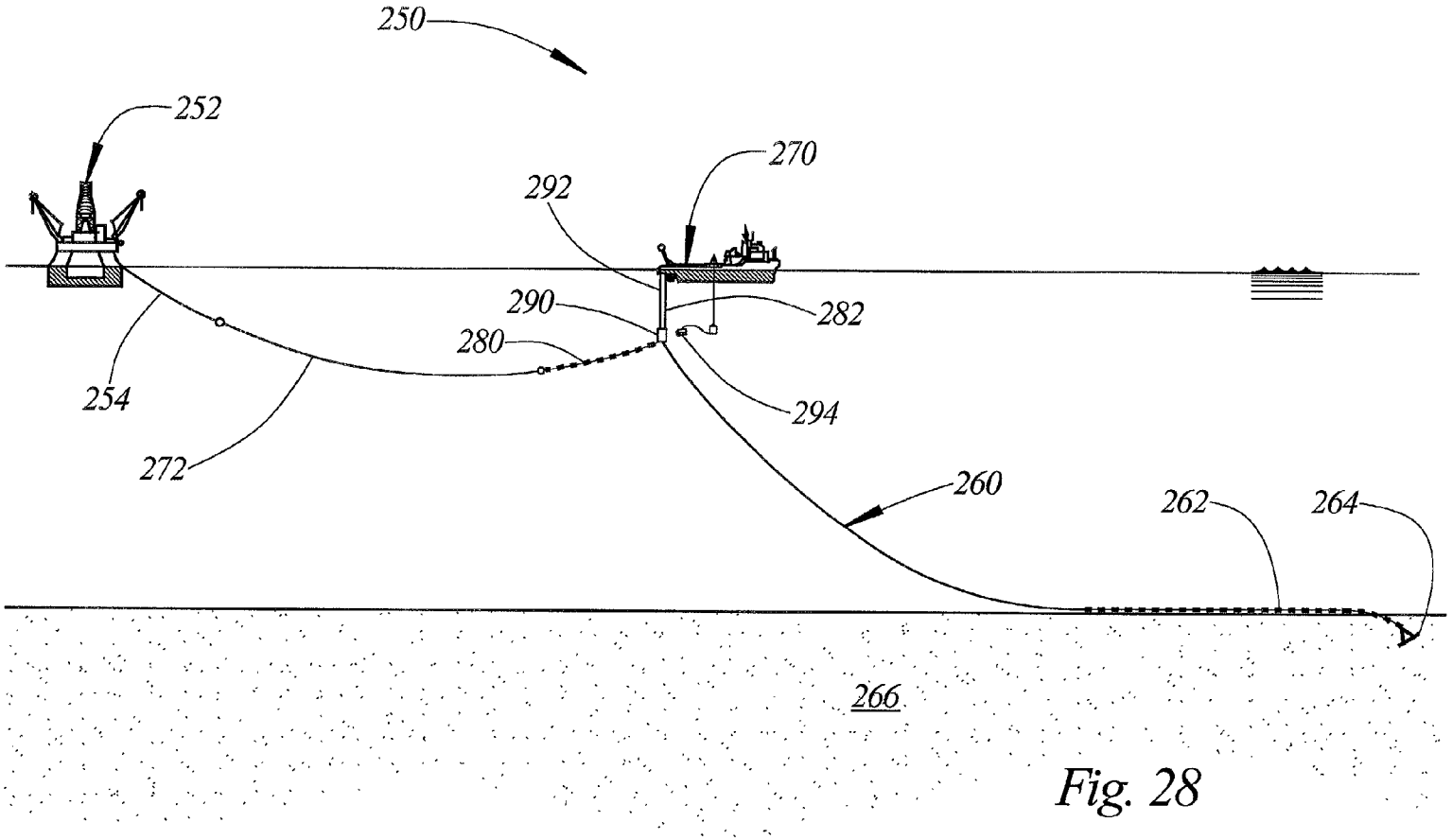
FIG. 28 is a diagrammatic illustration of a later step in the method of FIGS. 21 through 27, inclusive.

Referring to FIGS. 27 and 28, the anchor handling vessel recovers the work wire 284 through the clamping apparatus 290. The ROV 294 continues to monitor the connection between the line 292 and the clamping apparatus 290 and the movement of the work wire 294 through the clamping apparatus 290. The foregoing procedure continues until the chain section 280 is received in the clamping apparatus 290. At this point the pendant 282 has passed through the clamping apparatus 290. The ROV actuates the clamping apparatus 290 to engage the chain suction 280.

Figure 29:
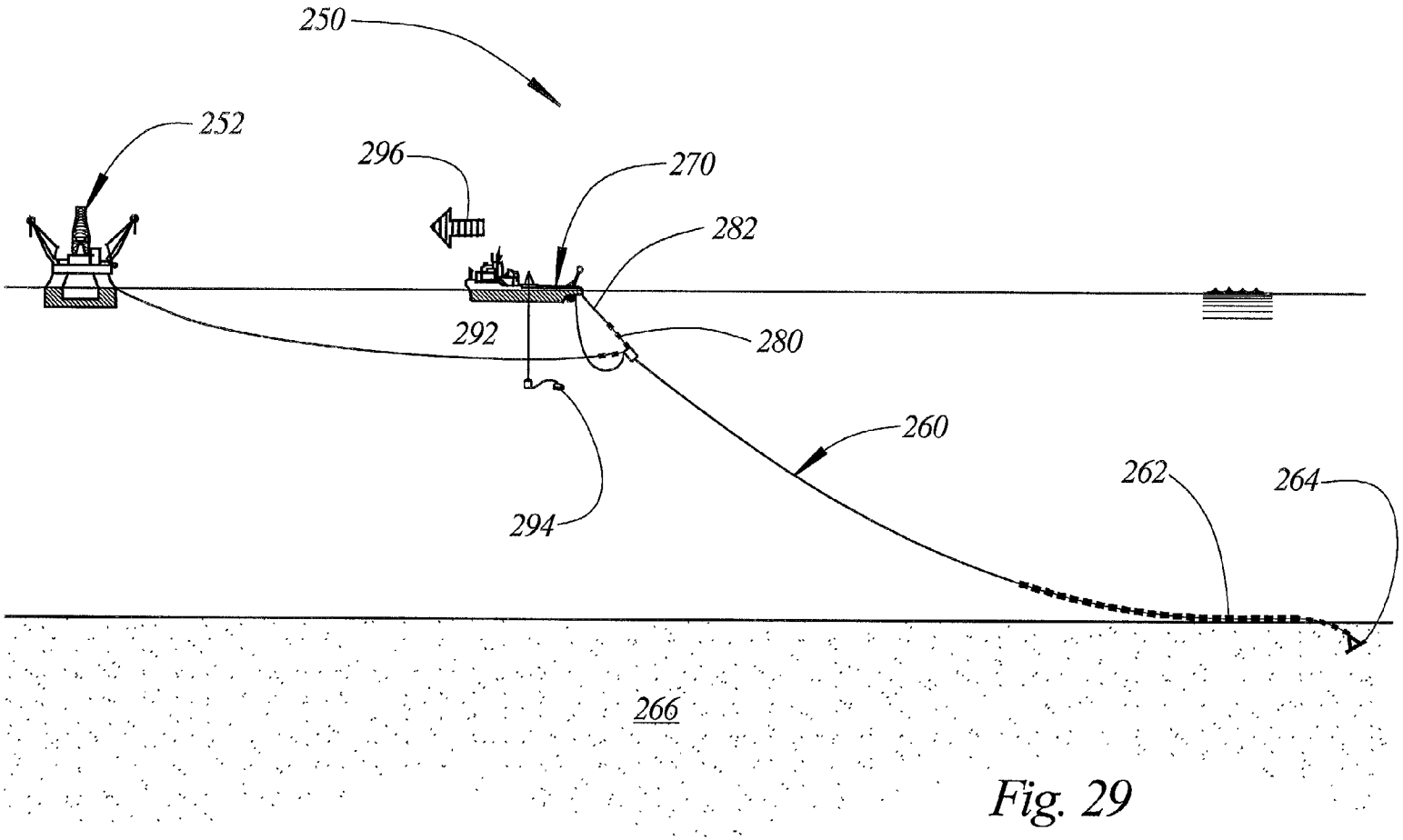
FIG. 29 is a diagrammatic illustration of a later step in the method of FIGS. 21 through 28, inclusive.

As is best shown in FIG. 29, the anchor handling vessel next reverses course so that it moves in the direction indicated by the arrow 296. The line 292 is paid out until it becomes slack. The engine power of the anchor handling vessel 270 is applied to the chain 280 whereby the chain 280 is drawn through the clamping apparatus 290 until a predetermined tension is applied to the VTBM and to the mooring line 260. The clamping apparatus 290 clamps the mooring line 260 to the line extending from the VTBM 252 comprising the pendant 254, the insert line 272, and the chain 280.

Figure 30:
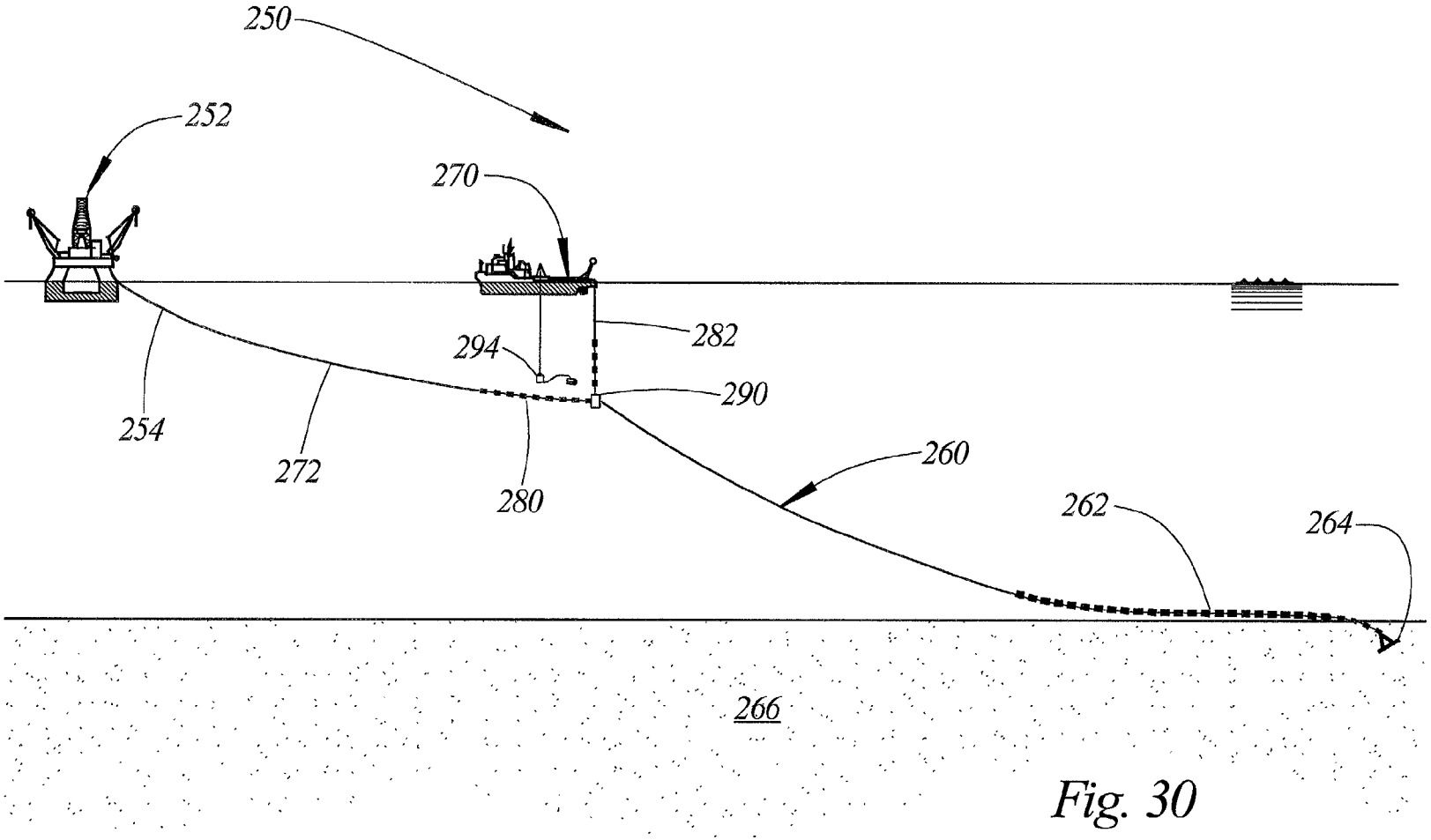
FIG. 30 is a diagrammatic illustration of a later step in the method of FIGS. 21 through 29, inclusive.
Figure 31:
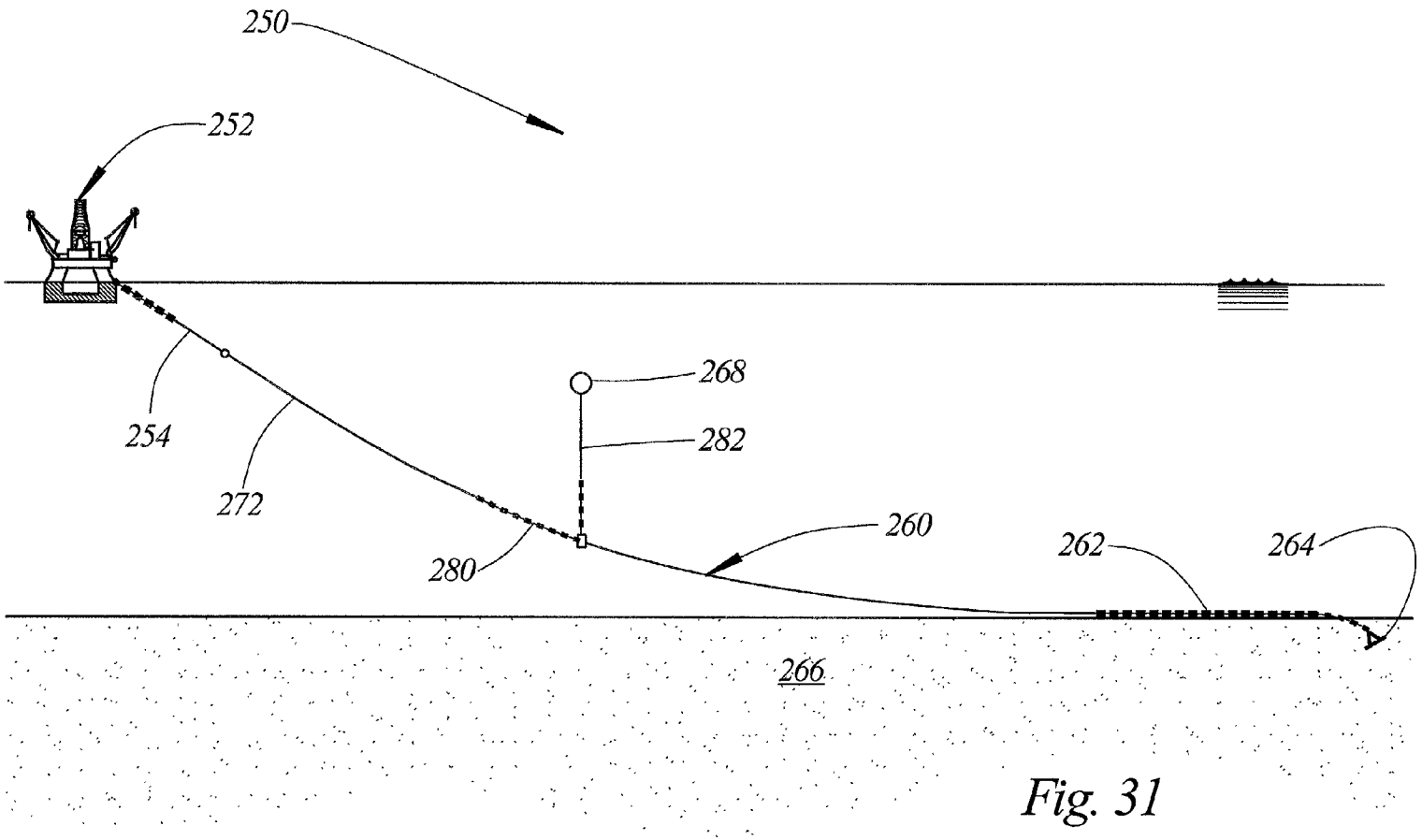
FIG. 31 is a diagrammatic illustration of a mooring installation constructed in accordance with the method of FIGS. 21 through 30, inclusive.

The next step of the method is illustrated in FIG. 30. The ROV 294 disconnects the line 292 from the clamping apparatus 290, and the line 292 is recovered onboard the anchor handling vessel 270. The pendant 282 is deployed from the anchor handling vessel 270 and the upper end thereof is secured in a sharks jaws retainer. The submersible buoy 268 is secured to the upper end of the pendant 282 while the work wire 284 remains secured to the pendant 282 below the buoy 268. The pendant 282 is released from the sharks jaws retainer and the work wire 284 is utilized to lower the clamping apparatus 290, the upper end of the chain 280, the pendant 282, and the buoy 268. When the lowering operation is complete, the work wire 284 is disconnected from the pendant 282 by the ROV 294, whereupon the component parts are positioned as illustrated in FIG. 31.

Figure 32:
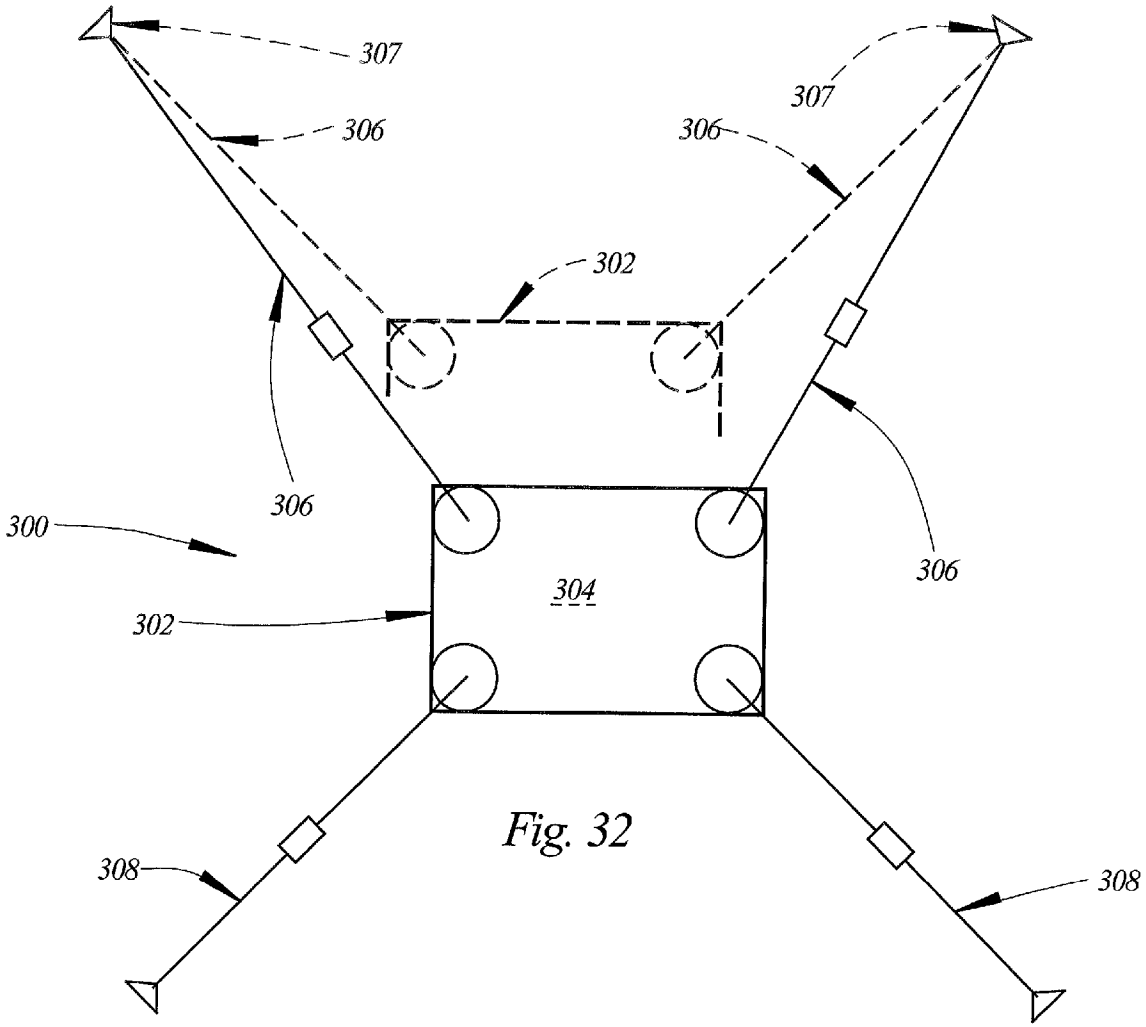
FIG. 32 is a diagrammatic illustration of a method of offshore mooring comprising a fifth embodiment of the invention.

A method of offshore mooring 190 comprising a fifth embodiment of the invention is illustrated in FIG. 32. In accordance with the fifth embodiment of the invention, a vessel to be moored (VTBM) 302 is moored at a mooring site 304 which is coincident with the illustration of the VTBM in full lines.

The VTBM 302 is initially positioned as indicated in dashed lines wherein the VTBM is somewhat displaced from the mooring site 304. With the VTBM situated at its displaced location, conventional mooring lines 306 are connected between anchoring points 307 and the VTBM 302. As will be appreciated by those skilled in the art, because the VTBM is situated at a location somewhat offset from the mooring site 304, sufficient slack is provided in the conventional mooring 306 to facilitate installation thereof.

After the conventional mooring lines 306 have been installed, the VTBM 302 is moved to the installation site 304. Thereafter, apparatus for offshore mooring 308 comprising the present invention are connected to the VTBM. The apparatus for offshore mooring 308 may comprise any of the embodiments disclosed herein and are adapted for activation by an anchor handling vessel. In this manner the anchor handling vessel is employed not only to apply predetermined tension to the apparatus for offshore mooring 308, but also to the conventional mooring lines 196.

Figure 33:
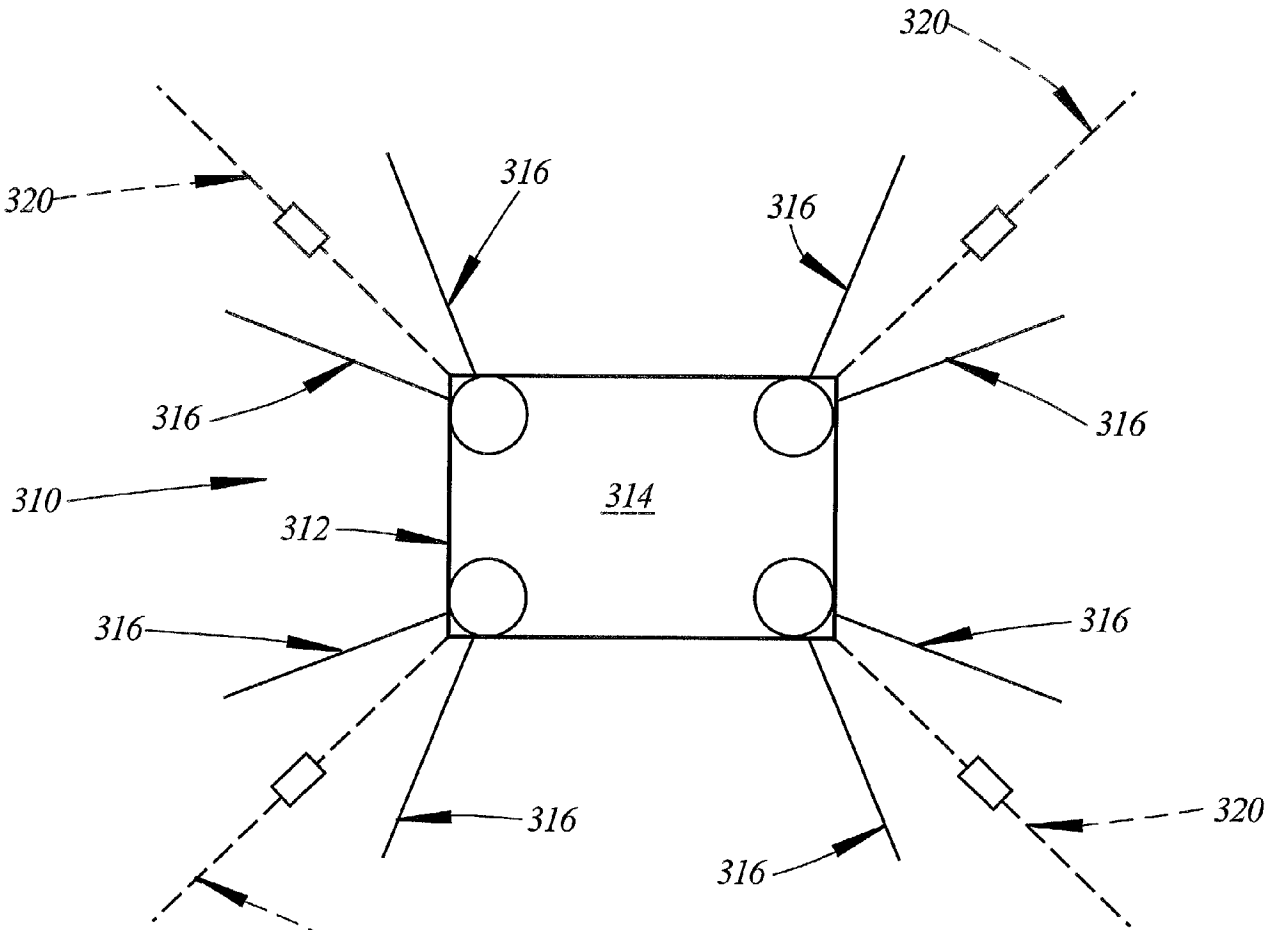
FIG. 33 is a diagrammatic illustration of a method of offshore mooring comprising a sixth embodiment of the invention.

Referring to FIG. 33, the method of and apparatus for offshore mooring 310 comprising a sixth embodiment of the invention is illustrated. In accordance with the fourth embodiment of the invention, a vessel to be moored (VTBM) 312 is situated at a mooring site 314 which is coincident with the outline of the VTBM as illustrated in FIG. 33. Conventional mooring lines 316 are connected to the VTBM. The conventional mooring lines 316 provide the VTBM with a predetermined mooring rating, for example, a ten year hurricane rating.

In accordance with the sixth embodiment of the invention, supplemental mooring systems 320 constructed in accordance with the present invention in addition to the conventional mooring lines 316. Each of the supplemental mooring systems 320 comprises a mooring line, a clamping apparatus, and a pendant extending from the VTBM to the mooring apparatus. Either the mooring line or the pendant extends through the clamping apparatus to the distal end adapted for the engagement by a line extending from an anchor handling vessel. The anchor handling vessel is utilized to apply a predetermined tension to each of the supplemental mooring systems 320. In this manner the mooring rating for the VTBM 312 is substantially raised, for example, from a ten year hurricane rating to a fifty year hurricane rating.

It will therefore be understood that the method of and apparatus for offshore mooring comprising the present invention is adapted for mooring mobile offshore drilling units, floating production platforms, SPARs, and other apparatus at offshore venues without requiring the use of mooring winches on the apparatus to be moored. Because the mooring winches which have heretofore been required to effect mooring operations at offshore venues are extremely expensive, the use of the method and apparatus of the present invention results in substantial cost savings.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A method of offshore mooring including the steps of:

providing a vessel to be moored;

providing a pendant;

securing the pendant to the vessel to be moored;

providing a preset mooring line having a distal end;

providing a clamping apparatus;

securing the clamping apparatus between the preset mooring line and the pendant;

providing an anchor handling vessel;

employing the anchor handling vessel to apply a predetermined tension between the pendant and the preset mooring line;

employing the clamping apparatus to securely clamp the pendant to the preset mooring line while maintaining the predetermined tension.

2. The method of offshore mooring according to claim 1 wherein the step of securing the pendant to the apparatus to be moored is carried out by mounting a padeye on the vessel to be moored and connecting the pendant to the padeye.

3. The method of offshore mooring according to claim 2 including the additional step of mounting a tension measuring device on the padeye and thereby generating a signal indicative of the tension applied to the padeye by the pendant.

4. The method of offshore mooring according to claim 1 wherein the step of providing a clamping apparatus is carried out by providing a clamping apparatus comprising a chain stopper and a pulley; wherein the step of providing a pendant is further characterized by providing a pendant having a distal end; and including the additional step of directing the distal end of the pendant through the chain stopper and around the pulley of the clamping apparatus.

5. The method of offshore mooring according to claim 4 wherein the step of providing a pendant having a distal end includes the step of providing a chain at the distal end of the pendant, and wherein the step of employing a clamping apparatus to securely clamp the pendant to the preset mooring line is carried out by engaging the chain stopper of the clamping apparatus with the chain comprising the distal end of the pendant.

6. The method of offshore mooring according to claim 5 including the additional step of employing a remote operated vehicle to engage the chain stopper with the chain comprising the distal end of the chain.

7. The method of offshore mooring according to claim 6 including the additional step of employing the remote operated vehicle to disengage the distal end of the pendant from the anchor handling vessel after the clamping apparatus has been actuated.

8. The method of offshore mooring according to claim 1 wherein the step of providing a clamping apparatus is carried out by providing a clamping apparatus comprising a stopper arm and a pulley; wherein the step of providing a pendant is further characterized by providing a pendant having a distal end; and including the additional step of directing the distal end of the pendant through the chain stopper and around the pulley of the clamping apparatus.

9. The method of offshore mooring according to claim 8 wherein the step of providing a pendant having a distal end includes the step of providing a chain at the distal end of the pendant, and wherein the step of employing a clamping apparatus to securely clamp the pendant to the preset mooring line is carried out by engaging the stopper arm of the clamping apparatus with the chain comprising the distal end of the pendant.

10. The method of offshore mooring according to claim 9 including the additional step of employing a remote operated vehicle to engage the stopper arm with the chain comprising the distal end of the chain.

11. The method of offshore mooring according to claim 10 including the additional step of employing the remote operated vehicle to disengage the distal end of the pendant from the anchor handling vessel after the clamping apparatus has been actuated.

12. The method of offshore mooring according to claim 1 including the additional steps of deploying a remote operated vehicle from the anchor handling vessel; and employing the remote operated vehicle to actuate the clamping apparatus to securely clamp the pendant to the preset mooring line.

13. The method of offshore mooring according to claim 12 wherein the step of providing a pendant is further characterized by providing a pendant having a distal end, and including the additional step of securing the distal end of the pendant to the anchor handling vessel.

14. The method of offshore mooring according to claim 13 including the additional step of employing the remote operated vehicle to disengage the distal end of the pendant from the anchor handling vessel after the clamping apparatus is actuated.

15. A method of offshore mooring including the steps of:

providing a vessel to be moored;

providing a pendant;

securing the pendant to the vessel to be moored;

providing a preset mooring line having a distal end;

providing a clamping apparatus;

securing the clamping apparatus between the preset mooring line and the pendant;

providing an anchor handling vessel having a propulsion system;

employing the anchor handling vessel propulsion system to apply a predetermined tension between the pendant and the preset mooring line;

employing the clamping apparatus to securely clamp the pendant to the preset mooring line while maintaining the predetermined tension.

16. The method of offshore mooring according to claim 15 wherein the step of securing the pendant to the apparatus to be moored is carried out by mounting a padeye on the vessel to be moored and connecting the pendant to the padeye.

17. The method of offshore mooring according to claim 16 including the additional step of mounting a tension measuring device on the padeye and thereby generating a signal indicative of the tension applied to the padeye by the pendant.

18. The method of offshore mooring according to claim 15 wherein the step of providing a clamping apparatus is carried out by providing a clamping apparatus comprising a chain stopper and a pulley; wherein the step of providing a pendant is further characterized by providing a pendant having a distal end; and including the additional step of directing the distal end of the pendant through the chain stopper and around the pulley of the clamping apparatus.

19. The method of offshore mooring according to claim 18 wherein the step of providing a pendant having a distal end includes the step of providing a chain at the distal end of the pendant, and wherein the step of employing a clamping apparatus to securely clamp the pendant to the preset mooring line is carried out by engaging the chain stopper of the clamping apparatus with the chain comprising the distal end of the pendant.

20. The method of offshore mooring according to claim 19 including the additional step of employing a remote operated vehicle to engage the chain stopper with the chain comprising the distal end of the chain.

21. The method of offshore mooring according to claim 20 including the additional step of employing the remote operated vehicle to disengage the distal end of the pendant from the anchor handling vessel after the clamping apparatus has been actuated.

22. The method of offshore mooring according to claim 15 wherein the step of providing a clamping apparatus is carried out by providing a clamping apparatus comprising a stopper arm and a pulley; wherein the step of providing a pendant is further characterized by providing a pendant having a distal end; and including the additional step of directing the distal end of the pendant through the chain stopper and around the pulley of the clamping apparatus.

23. The method of offshore mooring according to claim 22 wherein the step of providing a pendant having a distal end includes the step of providing a chain at the distal end of the pendant, and wherein the step of employing a clamping apparatus to securely clamp the pendant to the preset mooring line is carried out by engaging the stopper arm of the clamping apparatus with the chain comprising the distal end of the pendant.

24. The method of offshore mooring according to claim 22 including the additional step of employing a remote operated vehicle to engage the stopper arm with the chain comprising the distal end of the chain.

25. The method of offshore mooring according to claim 24 including the additional step of employing the remote operated vehicle to disengage the distal end of the pendant from the anchor handling vessel after the clamping apparatus has been actuated.

26. The method of offshore mooring according to claim 15 including the additional steps of deploying a remote operated vehicle from the anchor handling vessel; and employing the remote operated vehicle to actuate the clamping apparatus to securely clamp the pendant to the preset mooring line.

27. The method of offshore mooring according to claim 26 wherein the step of providing a pendant is further characterized by providing a pendant having a distal end, and including the additional step of securing the distal end of the pendant to the anchor handling vessel.

28. The method of offshore mooring according to claim 27 including the additional step of employing the remote operated vehicle to disengage the distal end of the pendant from the anchor handling vessel after the clamping apparatus is actuated.

29. A method of offshore mooring including the steps of:

providing a vessel to be moored;

providing a pendant;

securing the pendant to the vessel to be moored;

providing a preset mooring line having a distal end;

providing a clamping apparatus;

securing the clamping apparatus between the preset mooring line and the pendant;

providing an anchor handling vessel;

providing a winch on the anchor handling vessel;

employing the winch on the anchor handling vessel to apply a predetermined tension between the pendant and the preset mooring line;

employing the clamping apparatus to securely clamp the pendant to the preset mooring line while maintaining the predetermined tension.

30. The method of offshore mooring according to claim 29 wherein the step of securing the pendant to the apparatus to be moored is carried out by mounting a padeye on the vessel to be moored and connecting the pendant to the padeye.

31. The method of offshore mooring according to claim 30 including the additional step of mounting a tension measuring device on the padeye and thereby generating a signal indicative of the tension applied to the padeye by the pendant.

32. The method of offshore mooring according to claim 29 wherein the step of providing a clamping apparatus is carried out by providing a clamping apparatus comprising a chain stopper and a pulley; wherein the step of providing a pendant is further characterized by providing a pendant having a distal end; and including the additional step of directing the distal end of the pendant through the chain stopper and around the pulley of the clamping apparatus.

33. The method of offshore mooring according to claim 32 wherein the step of providing a pendant having a distal end includes the step of providing a chain at the distal end of the pendant, and wherein the step of employing a clamping apparatus to securely clamp the pendant to the preset mooring line is carried out by engaging the chain stopper of the clamping apparatus with the chain comprising the distal end of the pendant.

34. The method of offshore mooring according to claim 33 including the additional step of employing a remote operated vehicle to engage the chain stopper with the chain comprising the distal end of the chain.

35. The method of offshore mooring according to claim 34 including the additional step of employing the remote operated vehicle to disengage the distal end of the pendant from the anchor handling vessel after the clamping apparatus has been actuated.

36. The method of offshore mooring according to claim 29 wherein the step of providing a clamping apparatus is carried out by providing a clamping apparatus comprising a stopper arm and a pulley; wherein the step of providing a pendant is further characterized by providing a pendant having a distal end; and including the additional step of directing the distal end of the pendant through the chain stopper and around the pulley of the clamping apparatus.

37. The method of offshore mooring according to claim 36 wherein the step of providing a pendant having a distal end includes the step of providing a chain at the distal end of the pendant, and wherein the step of employing a clamping apparatus to securely clamp the pendant to the preset mooring line is carried out by engaging the stopper arm of the clamping apparatus with the chain comprising the distal end of the pendant.

38. The method of offshore mooring according to claim 37 including the additional step of employing a remote operated vehicle to engage the stopper arm with the chain comprising the distal end of the chain.

39. The method of offshore mooring according to claim 38 including the additional step of employing the remote operated vehicle to disengage the distal end of the pendant from the anchor handling vessel after the clamping apparatus has been actuated.

40. The method of offshore mooring according to claim 29 including the additional steps of deploying a remote operated vehicle from the anchor handling vessel; and employing the remote operated vehicle to actuate the clamping apparatus to securely clamp the pendant to the preset mooring line.

41. The method of offshore mooring according to claim 40 wherein the step of providing a pendant is further characterized by providing a pendant having a distal end, and including the additional step of securing the distal end of the pendant to the anchor handling vessel.

42. The method of offshore mooring according to claim 41 including the additional step of employing the remote operated vehicle to disengage the distal end of the pendant from the anchor handling vessel after the clamping apparatus is actuated.

43. A method of mooring a vessel at an offshore venue comprising the steps of:

providing a pendant having an end secured to the vessel to be moored and having a distal end;

providing a preset mooring line including an anchor secured in engagement with the sea floor and having a distal end;

providing a clamping apparatus including a clamping mechanism and a pulley;

securing the clamping apparatus to the distal end of the preset mooring line;

passing the distal end of the pendant through the clamping mechanism and around the pulley of the clamping apparatus;

applying a force to the distal end of the pendant and thereby establishing a predetermined tension between the anchor, the preset mooring line, the pendant, and the vessel to be moored;

actuating the clamping mechanism of the clamping apparatus to securely clamp the pendant in engagement with the preset mooring line while maintaining the predetermined tension therebetween.

44. The method of mooring a vessel at an offshore venue according to claim 43 wherein the step of applying a force to the distal end of the pendant is carried out by connecting the distal end of the pendant to a winch, and thereafter operating the winch to apply the force to the distal end of the pendant.

45. The method of mooring an apparatus at an offshore venue according to claim 44 including the additional step of mounting the winch on an anchor handling vessel.

46. The method of mooring a vessel at an offshore venue according to claim 45 including the additional steps of:

deploying a remote operated vehicle from the anchor handling vessel; and utilizing the remote operated vehicle to actuate the clamping mechanism of the clamping apparatus.

47. The method of mooring a vessel at an offshore venue according to claim 46 including the additional step of employing the remote operated vehicle to disconnect the distal end of the pendant from the winch subsequent to actuation of the clamping mechanism.

48. The method of mooring a vessel at an offshore venue according to claim 43 further characterized by:

providing an anchor handling vessel having a propulsion system;

securing the distal end of the pendant to the anchor handling vessel; and using the propulsion system of the anchor handling vessel apply the force to the distal end of the pendant.

49. The method of mooring a vessel at an offshore venue according to claim 48 including the additional step of disengaging the pendant from the anchor handling vessel subsequent to actuation of the clamping mechanism.

50. A method of mooring a vessel at an offshore venue comprising the steps of:

providing a pendant having an end secured to the vessel to be moored and having a distal end;

providing a preset mooring line including an anchor secured in engagement with the sea floor and having a distal end;

providing a clamping apparatus including a clamping mechanism and a pulley;

securing the clamping apparatus to the distal end of the pendant;

passing the distal end of the mooring line through the clamping mechanism and around the pulley of the clamping apparatus;

applying a force to the distal end of the mooring line and thereby establishing a predetermined tension between the anchor, the preset mooring line, the pendant, and the vessel to be moored;

actuating the clamping mechanism of the clamping apparatus to securely clamp the pendant in engagement with the preset mooring line while maintaining the predetermined tension therebetween.

51. The method of mooring a vessel at an offshore venue according to claim 50 wherein the step of applying a force to the distal end of the mooring line is carried out by connecting the distal end of the mooring line to a winch, and thereafter operating the winch to apply the force to the distal end of the mooring line.

52. The method of mooring a vessel at an offshore venue according to claim 51 including the additional step of mounting the winch on an anchor handling vessel.

53. The method of mooring a vessel at an offshore venue according to claim 52 including the additional steps of:

deploying a remote operated vehicle from the anchor handling vessel; and utilizing the remote operated vehicle to actuate the clamping mechanism of the clamping apparatus.

54. The method of mooring a vessel at an offshore venue according to claim 53 including the additional step of employing the remote operated vehicle to disconnect the distal end of the mooring line from the winch subsequent to actuation of the clamping mechanism.

55. The method of mooring a vessel at an offshore venue according to claim 50 further characterized by:

providing an anchor handling vessel having a propulsion system;

securing the distal end of the mooring line to the anchor handling vessel; and using the propulsion system of the anchor handling vessel apply the force to the distal end of the mooring line.

56. The method of mooring a vessel at an offshore venue according to claim 55 including the additional step of disengaging the mooring line from the anchor handling vessel subsequent to activation of the clamping mechanism.

57. The method of mooring a vessel at an offshore venue according to claim 50 further characterized by:

providing an anchor handling vessel having a propulsion system;

securing the distal end of the pendant to the anchor handling vessel; and using the propulsion system of the anchor handling vessel apply the force to the distal end of the pendant.

58. The method of mooring a vessel at an offshore venue according to claim 57 including the additional step of disengaging the pendant from the anchor handling vessel subsequent to actuation of the clamping mechanism.

59. A system for mooring a vessel at an offshore venue comprising:

a pendant secured to the vessel to be moored and extending to a distal end;

an anchor secured in the sea floor;

a preset mooring line extending from the anchor to a distal end;

means for applying a predetermined tension between the preset mooring line and the pendant; and a clamping apparatus mounted between the preset mooring line and the pendant for securely clamping the pendant into engagement with the preset mooring line while maintaining the predetermined tension therebetween.

60. The system for mooring a vessel at an offshore venue according to claim 59 wherein the clamping apparatus includes a clamping mechanism and a pulley and wherein the distal end of the pendant extends through the clamping mechanism and around the pulley of the clamping apparatus.

61. The system for mooring a vessel at an offshore venue according to claim 59 wherein the clamping apparatus includes a clamping mechanism and a pulley and wherein the distal end of the mooring line extends through the clamping mechanism and around the pulley.

62. The system for mooring a vessel at an offshore venue according to claim 59 further including a remote operated vehicle for actuating the clamping mechanism of the clamping apparatus to securely clamp the pendant and the preset mooring line in engagement with one another.

63. The system for mooring an apparatus at an offshore venue according to claim 59 wherein the means for applying a predetermined tension between the preset mooring line and the pendant comprises a winch mounted on an anchor handling vessel and a line extending from the winch.

64. The system for mooring an apparatus at an offshore venue according to claim 63 further including a remote operated vehicle for disengaging the distal end of the line extending from the winch after the clamping apparatus is actuated.

65. The system for mooring a vessel at an offshore venue according to claim 59 wherein the clamping apparatus includes a clamping mechanism and a pulley and wherein the distal end of the pendant extends through the clamping mechanism and around the pulley of the clamping apparatus, wherein the means for applying a predetermined tension between the preset mooring line and the pendant comprises a winch mounted on an anchor handling vessel and a line extending from the winch and connected to the distal end of the pendant, and further including a remote operated vehicle for actuating the clamping mechanism of the clamping apparatus to securely clamp the pendant into engagement with a preset mooring line, and for thereafter disengaging the distal end of the pendant from the line extending from the winch after the clamping apparatus has been actuated.

66. The system for mooring a vessel at an offshore venue according to claim 59 further characterized by a line extending upwardly from the clamping mechanism and a submersible buoy secured to the end of the line for maintaining the line in a vertical orientation.

67. A system for mooring a vessel at an offshore venue comprising:

a pendant having an end secured to the vessel to be moored and having a distal end;

a preset mooring line including an anchor secured into engagement with the sea floor and having a distal end;

a clamping apparatus including a clamping mechanism and a pulley;

means securing the clamping apparatus to the distal end of the preset mooring line;

the distal end of the pendant extending through the clamping mechanism and around the pulley of the clamping apparatus;

means for applying force to the distal end of the pendant and thereby establishing a predetermined tension between the anchor, the preset mooring line, the pendant, and the vessel to be moored; and means for actuating the clamping mechanism of the clamping apparatus to securely clamp the pendant into engagement with the preset mooring line while maintaining the predetermined tension therebetween.

68. The system for mooring a vessel at an offshore venue according to claim 67 wherein the means for applying a force to the distal end of the pendant comprises a winch and a line extending from the winch and connected to the distal end of the pendant.

69. The system for mooring a vessel at an offshore venue according to claim 68 further including an anchor handling vessel having the winch mounted thereon.

70. The system for mooring a vessel at an offshore venue according to claim 69 further including a remotely operated vehicle for actuating the clamping mechanism of the clamping apparatus to securely clamp the pendant into engagement with the preset mooring line and for thereafter disconnecting the distal end of the pendant from the line extending from the winch.

71. The system of mooring a vessel at an offshore venue according to claim 67 wherein the means for applying force to the distal end of the pendant comprises an anchor handling vessel having a propulsion system and means for securing the distal end of the pendant to the anchor handling vessel thereby facilitating use of the propulsion system of the anchor handling vessel to apply force to the pendant.

72. A method of mooring a vessel at a predetermined offshore mooring site comprising the steps of;

providing a vessel to be moored;

initially locating the vessel to be moored at a location displaced from the predetermined mooring site;

connecting at least one first mooring line to the vessel to be moored while the vessel to be moored is at the displaced location;

subsequently positioning the vessel to be moored at the predetermined offshore mooring site;

providing at least one pendant;

securing the pendant to the vessel to be moored;

providing at least one preset mooring line having a distal end;

providing a clamping apparatus;

securing the clamping apparatus between the preset mooring line and the pendant;

providing an anchor handling vessel;

employing the anchor handling vessel to apply a predetermined tension between the pendant and the preset mooring line and thereby applying tension to the first mooring line;

employing the clamping apparatus to securely clamp the pendant to the preset mooring line while maintaining tension on the line and on the first mooring line.

73. The method of offshore mooring according to claim 72 wherein the step of providing a clamping apparatus is carried out by providing a clamping apparatus comprising a chain stopper and a pulley; wherein the step of providing a pendant is further characterized by providing a pendant having a distal end; and including the additional step of directing the distal end of the pendant through the chain stopper and around the pulley of the clamping apparatus.

74. The method of offshore mooring according to claim 73 wherein the step of providing a pendant having a distal end includes the step of providing a chain at the distal end of the pendant, and wherein the step of employing a clamping apparatus to securely clamp the pendant to the preset mooring line is carried out by engaging the chain stopper of the clamping apparatus with the chain comprising the distal end of the pendant.

75. The method of offshore mooring according to claim 74 including the additional step of employing a remote operated vehicle to engage the chain stopper with the chain comprising the distal end of the chain.

76. The method of offshore mooring according to claim 75 including the additional step of employing the remote operated vehicle to disengage the distal end of the pendant from the anchor handling vessel after the clamping apparatus has been actuated.

77. The method of offshore mooring according to claim 72 wherein the step of providing a clamping apparatus is carried out by providing a clamping apparatus comprising a stopper arm and a pulley; wherein the step of providing a pendant is further characterized by providing a pendant having a distal end; and including the additional step of directing the distal end of the pendant through the chain stopper and around the pulley of the clamping apparatus.

78. The method of offshore mooring according to claim 77 wherein the step of providing a pendant having a distal end includes the step of providing a chain at the distal end of the pendant, and wherein the step of employing a clamping apparatus to securely clamp the pendant to the preset mooring line is carried out by engaging the stopper arm of the clamping apparatus with the chain comprising the distal end of the pendant.

79. The method of offshore mooring according to claim 78 including the additional step of employing a remote operated vehicle to engage the stopper arm with the chain comprising the distal end of the chain.

80. The method of offshore mooring according to claim 79 including the additional step of employing the remote operated vehicle to disengage the distal end of the pendant from the anchor handling vessel after the clamping apparatus has been actuated.

81. For use in conjunction with a mooring installation of the type comprising a plurality of mooring lines secured to a moored vessel at spaced points around the periphery thereof and characterized by a predetermined storm resistance rating, a method of increasing the storm resistance rating of the mooring installation including the steps of:

providing at least one pendant;

securing the pendant to the moored vessel;

providing at least one preset mooring line having a distal end;

providing a clamping apparatus;

securing the clamping apparatus between the preset mooring line and the pendant;

providing an anchor handling vessel;

employing the anchor handling vessel to apply a predetermined tension between the pendant and the preset mooring line;

employing the clamping apparatus to securely clamp the pendant to the preset mooring line while maintaining the predetermined tension.

82. The method of offshore mooring according to claim 81 wherein the step of providing a clamping apparatus is carried out by providing a clamping apparatus comprising a chain stopper and a pulley; wherein the step of providing a pendant is further characterized by providing a pendant having a distal end; and including the additional step of directing the distal end of the pendant through the chain stopper and around the pulley of the clamping apparatus.

83. The method of offshore mooring according to claim 82 wherein the step of providing a pendant having a distal end includes the step of providing a chain at the distal end of the pendant, and wherein the step of employing a clamping apparatus to securely clamp the pendant to the preset mooring line is carried out by engaging the chain stopper of the clamping apparatus with the chain comprising the distal end of the pendant.

84. The method of offshore mooring according to claim 83 including the additional step of employing a remote operated vehicle to engage the chain stopper with the chain comprising the distal end of the chain.

85. The method of offshore mooring according to claim 84 including the additional step of employing the remote operated vehicle to disengage the distal end of the pendant from the anchor handling vessel after the clamping apparatus has been actuated.

86. The method of offshore mooring according to claim 81 wherein the step of providing a clamping apparatus is carried out by providing a clamping apparatus comprising a stopper arm and a pulley; wherein the step of providing a pendant is further characterized by providing a pendant having a distal end; and including the additional step of directing the distal end of the pendant through the chain stopper and around the pulley of the clamping apparatus.

87. The method of offshore mooring according to claim 86 wherein the step of providing a pendant having a distal end includes the step of providing a chain at the distal end of the pendant, and wherein the step of employing a clamping apparatus to securely clamp the pendant to the preset mooring line is carried out by engaging the stopper arm of the clamping apparatus with the chain comprising the distal end of the pendant.

88. The method of offshore mooring according to claim 87 including the additional step of employing a remote operated vehicle to engage the stopper arm with the chain comprising the distal end of the chain.

89. The method of offshore mooring according to claim 88 including the additional step of employing the remote operated vehicle to disengage the distal end of the pendant from the anchor handling vessel after the clamping apparatus has been actuated.

90. The method of offshore mooring according to claim 81 including the additional steps of deploying a remote operated vehicle from the anchor handling vessel; and employing the remote operated vehicle to actuate the clamping apparatus to securely clamp the pendant to the preset mooring line.

91. The method of offshore mooring according to claim 90 wherein the step of providing a pendant is further characterized by providing a pendant having a distal end, and including the additional step of securing the distal end of the pendant to the anchor handling vessel.

92. The method of offshore mooring according to claim 91 including the additional step of employing the remote operated vehicle to disengage the distal end of the pendant from the anchor handling vessel after the clamping apparatus is actuated.

* * * * *